US008095996B2

(12) United States Patent
Turner

(10) Patent No.: US 8,095,996 B2
(45) Date of Patent: Jan. 17, 2012

(54) APPAREL INCORPORATING A PROTECTIVE ELEMENT

(75) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 400 days.

(21) Appl. No.: 12/490,001

(22) Filed: Jun. 23, 2009

(65) Prior Publication Data

US 2010/0319097 A1 Dec. 23, 2010

(51) Int. Cl.

| | |
|---|---|
| ***A41D 27/26*** | (2006.01) |
| ***A41D 31/02*** | (2006.01) |
| ***A41D 27/12*** | (2006.01) |
| *A41D 13/00* | (2006.01) |

(52) U.S. Cl. ..... 2/456; 2/22; 2/24; 2/267; 2/463; 2/464

(58) Field of Classification Search ..... 2/2, 16, 2/22, 24, 267, 268, 243 R, 243 A, DIG. 1, 2/44, 45; 128/157, 89 R, 156

See application file for complete search history.

(56) References Cited

U.S. PATENT DOCUMENTS

| | | | | | |
|---|---|---|---|---|---|
| 3,119,904 | A | | 1/1964 | Anson | |
| 3,500,472 | A | | 3/1970 | Castellani | |
| 3,772,704 | A | * | 11/1973 | Carbonneau | 2/22 |
| 3,991,420 | A | * | 11/1976 | Savarino | 2/462 |
| 4,525,875 | A | | 7/1985 | Tomczak | |
| 4,580,297 | A | * | 4/1986 | Maejima | 2/22 |
| 4,599,747 | A | * | 7/1986 | Robinson | 2/461 |
| 4,688,269 | A | * | 8/1987 | Maeshima | 2/456 |
| 4,982,447 | A | | 1/1991 | Henson | |
| 5,014,354 | A | * | 5/1991 | Dumont | 2/23 |
| 5,052,052 | A | * | 10/1991 | Gilford et al. | 2/467 |
| 5,067,175 | A | * | 11/1991 | Gold | 2/16 |
| 5,168,576 | A | * | 12/1992 | Krent et al. | 2/456 |
| 5,220,691 | A | * | 6/1993 | Wiegers | 2/24 |
| 5,337,418 | A | * | 8/1994 | Kato et al. | 2/456 |
| 5,373,584 | A | * | 12/1994 | Parcells, III | 2/465 |
| 5,423,087 | A | * | 6/1995 | Krent et al. | 2/463 |
| 5,530,966 | A | * | 7/1996 | West | 2/462 |
| 5,621,914 | A | * | 4/1997 | Ramone et al. | 2/463 |
| 5,689,836 | A | | 11/1997 | Fee | |
| 5,729,832 | A | * | 3/1998 | Grilliot et al. | 2/23 |
| 5,940,888 | A | | 8/1999 | Sher | |
| 5,948,621 | A | * | 9/1999 | Turner et al. | 435/6.11 |
| 6,105,162 | A | | 8/2000 | Douglas et al. | |
| 6,205,583 | B1 | * | 3/2001 | Beland | 2/16 |
| 6,295,654 | B1 | * | 10/2001 | Farrell | 2/456 |

(Continued)

OTHER PUBLICATIONS

International Search Report and Written Opinion for PCT/US2010/039426, mailed Oct. 12, 2010.

*Primary Examiner* — Bobby Muromoto, Jr.
(74) *Attorney, Agent, or Firm* — Plumsea Law Group, LLC

(57) ABSTRACT

Protective elements may include a pair of material layers, a plurality of pad components, and a plate. The pad components may be located between the material layers, and the plate may be positioned adjacent to one of the material layers and opposite the pad components. Similar protective elements may also be utilized with apparel systems. For example, an inner garment may include the protective element, and an outer garment may extend over the inner garment. The outer garment may include an outer pad locatable to extend over the plate, and the outer pad may have a greater area than the plate.

30 Claims, 27 Drawing Sheets

U.S. PATENT DOCUMENTS

| | | | | |
|---|---|---|---|---|
| 6,401,366 | B2 * | 6/2002 | Foxen et al. | 36/91 |
| 6,510,560 | B1 * | 1/2003 | Ugolnik | 2/455 |
| 6,519,782 | B2 * | 2/2003 | Collins et al. | 2/463 |
| 6,654,960 | B2 | 12/2003 | Cho | |
| 6,743,325 | B1 | 6/2004 | Taylor | |
| 6,817,039 | B1 * | 11/2004 | Grilliot et al. | 2/413 |
| 7,114,189 | B1 | 10/2006 | Kleinert | |
| 7,188,370 | B2 * | 3/2007 | Bevier | 2/22 |
| 7,316,083 | B2 * | 1/2008 | Labonte | 36/115 |
| 7,350,240 | B2 * | 4/2008 | LaGrone | 2/51 |
| 7,512,996 | B2 * | 4/2009 | Yoo et al. | 2/455 |
| 7,707,658 | B2 * | 5/2010 | Culhane | 2/227 |
| 7,743,429 | B2 * | 6/2010 | Bevier | 2/22 |
| 7,832,017 | B2 * | 11/2010 | Nascimento et al. | 2/22 |
| 2004/0229763 | A1 * | 11/2004 | Hutton et al. | 510/220 |
| 2005/0167029 | A1 * | 8/2005 | Rapaport et al. | 156/145 |
| 2005/0246812 | A1 * | 11/2005 | Bevier | 2/22 |
| 2006/0260026 | A1 * | 11/2006 | Doria et al. | 2/414 |
| 2007/0000005 | A1 | 1/2007 | Wang | |
| 2007/0124843 | A1 * | 6/2007 | Bevier | 2/22 |
| 2008/0178360 | A1 * | 7/2008 | Nascimento et al. | 2/22 |
| 2008/0178361 | A1 * | 7/2008 | Yoo et al. | 2/24 |
| 2008/0264557 | A1 | 10/2008 | Kim | |
| 2008/0290556 | A1 | 11/2008 | Kim | |
| 2009/0070911 | A1 | 3/2009 | Chang | |
| 2009/0152774 | A1 * | 6/2009 | Hensley et al. | 264/524 |
| 2009/0288312 | A1 * | 11/2009 | Dua | 36/29 |
| 2009/0288313 | A1 * | 11/2009 | Rapaport et al. | 36/29 |
| 2010/0024089 | A1 * | 2/2010 | Turner | 2/23 |
| 2010/0024100 | A1 * | 2/2010 | Sokolowski et al. | 2/455 |
| 2010/0024101 | A1 * | 2/2010 | Berner et al. | 2/455 |
| 2010/0129573 | A1 | 5/2010 | Kim | |
| 2010/0193117 | A1 | 8/2010 | Kim | |
| 2010/0199406 | A1 * | 8/2010 | Dua et al. | 2/115 |
| 2010/0205716 | A1 | 8/2010 | Kim | |
| 2010/0205722 | A1 | 8/2010 | Kim | |
| 2010/0206472 | A1 | 8/2010 | Kim | |

* cited by examiner

APPAREL INCORPORATING A PROTECTIVE ELEMENT

BACKGROUND

Articles of athletic apparel commonly incorporate elements that cushion or protect an athlete from contact with other athletes, equipment, or the ground. Examples of these elements include (a) foam components that impart cushioning or otherwise attenuate impact forces and (b) rigid or semi-rigid plates that distribute impact forces. Many articles of athletic apparel combine foam components and plates to protect to the athlete by both attenuating and distributing impact forces. That is, the combination of a foam component and a plate may impart enhanced protection by both attenuating and distributing impact forces. As an example, shoulder pads and thigh pads worn under uniforms in American football include (a) foam components located adjacent to the athlete (i.e., in contact with the athlete or apparel worn adjacent to the skin of the athlete) and (b) plates secured to the foam components and located opposite the athlete. As another example, helmets utilized during American football, bicycling, hockey, skiing, snowboarding, and skateboarding also effectively combine polymer foam components with an external plate (i.e., the exterior of the helmet).

SUMMARY

Various protective elements that may be utilized in apparel are disclosed below. In general, the protective elements include a pair of material layers, a plurality of pad components, and a plate. The pad components may be located between the material layers, and the plate may be positioned adjacent to one of the material layers and opposite the pad components. Similar protective elements may also be utilized with apparel systems. For example, an inner garment may include the protective element, and an outer garment may extend over the inner garment. The outer garment may include an outer pad locatable to extend over the plate, and the outer pad may have a greater area than the plate.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various apparel systems, articles of apparel, cushioning elements, and protective elements that may be incorporated into the apparel systems or articles of apparel.

Apparel System

Figure 1:
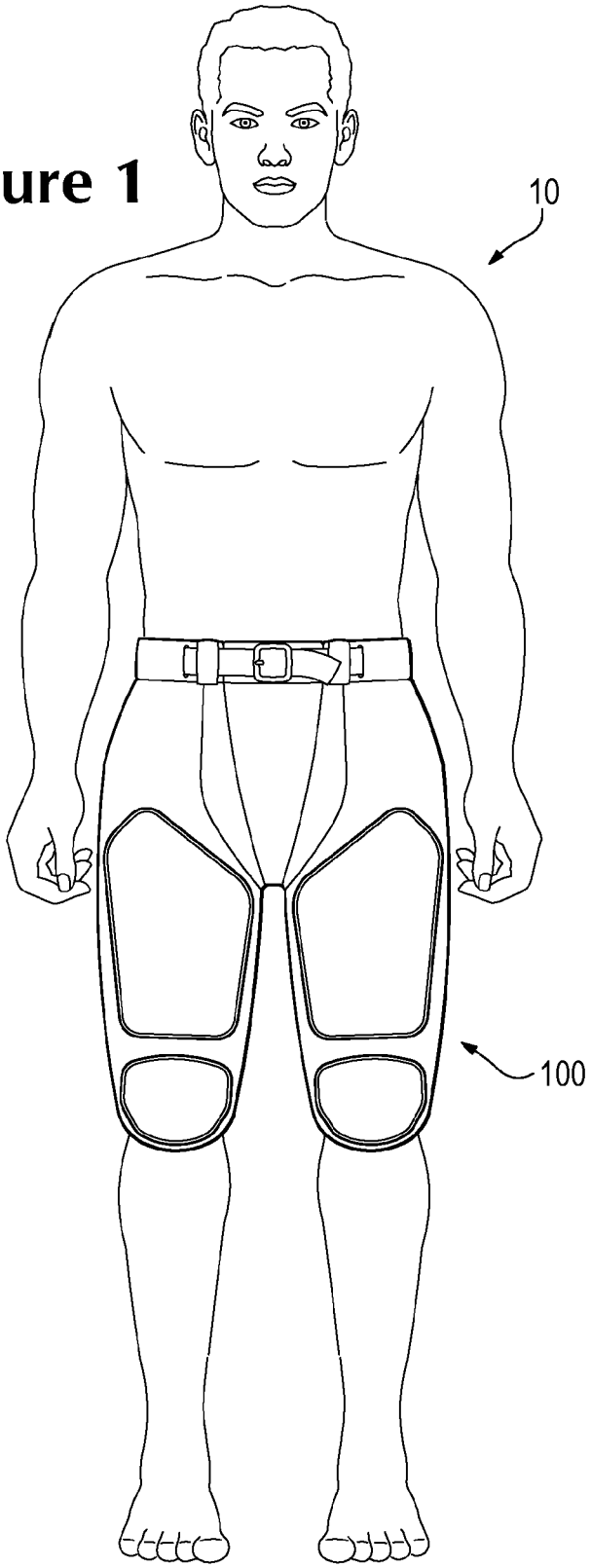
FIG. 1 is a front elevational view of an individual wearing an apparel system having an outer garment and an inner garment.
Figure 2:
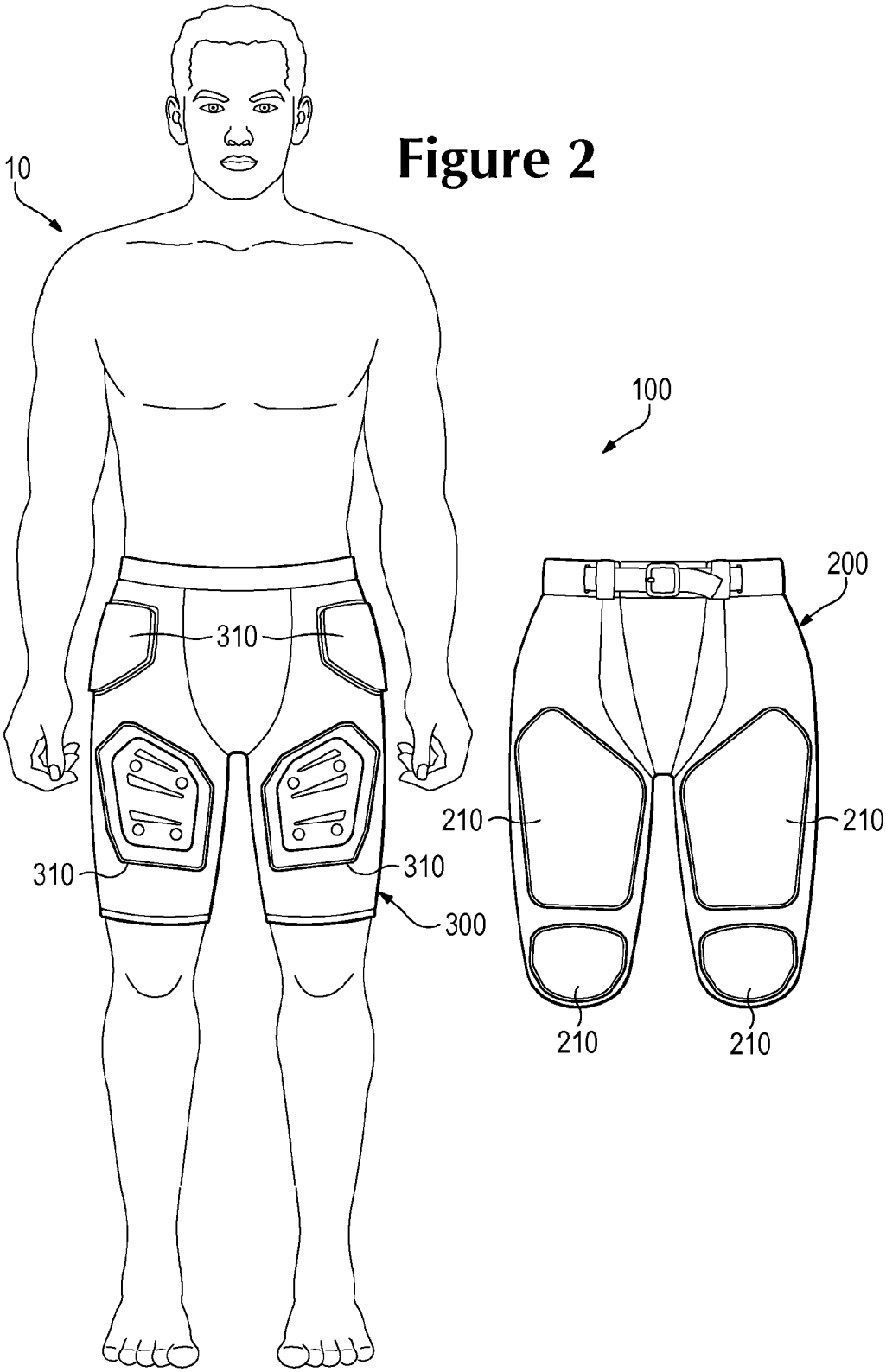
FIG. 2 is an exploded front elevational view of the individual wearing the apparel system.
Figure 3:
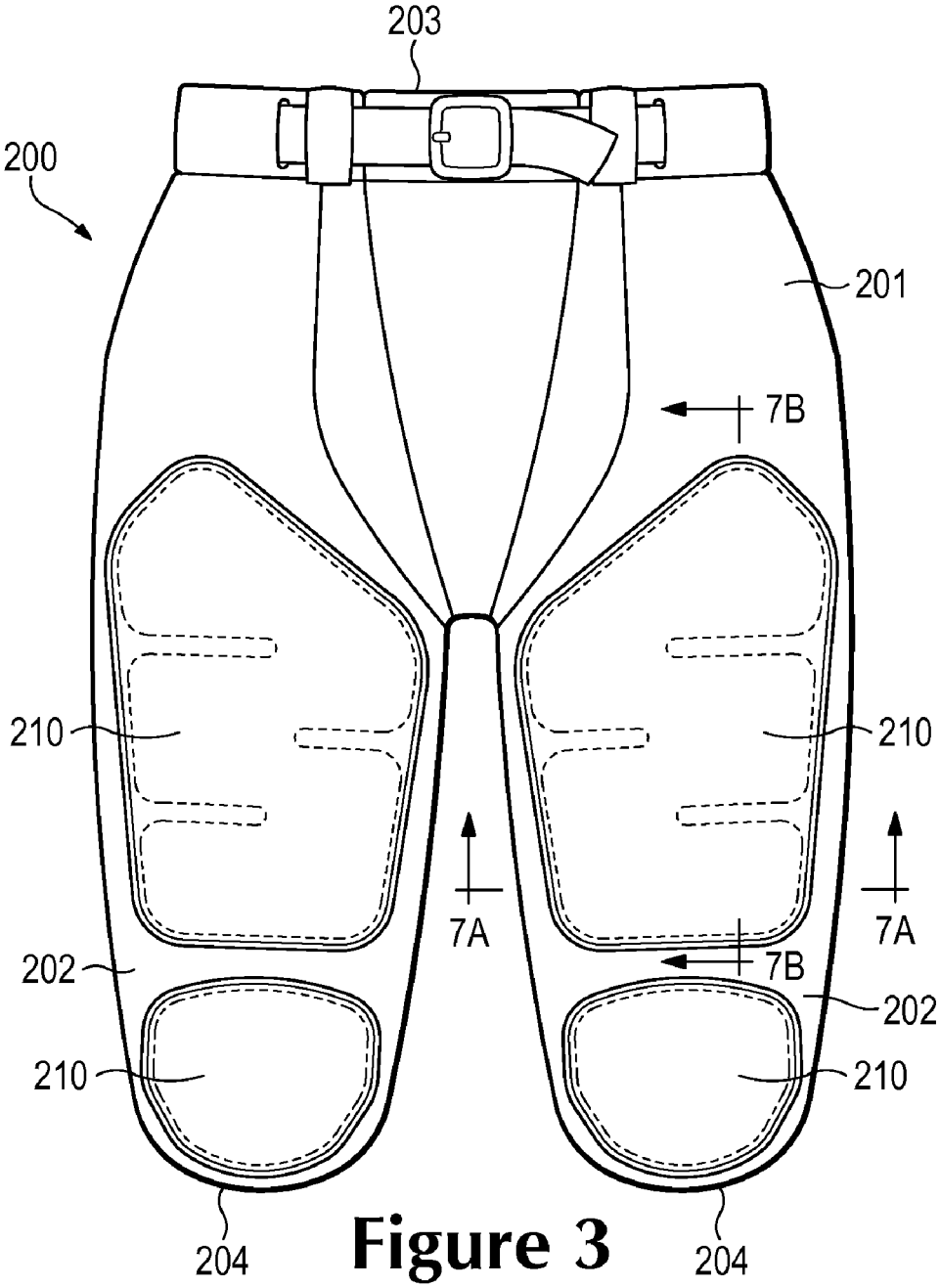
FIG. 3 is a front elevational view of the outer garment.
Figure 4:
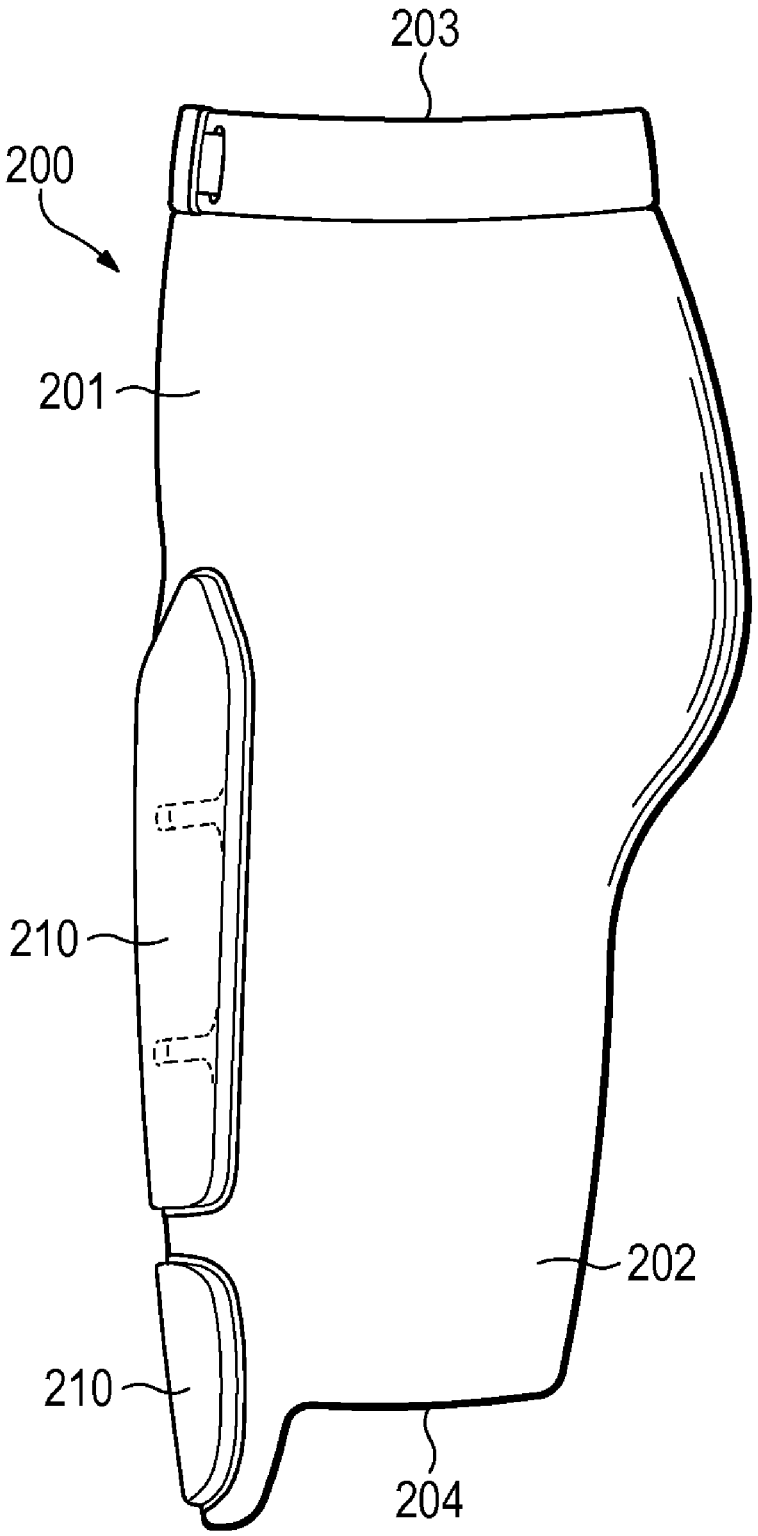
FIGS. 4 and 5 are side elevational views of the outer garment.
Figure 5:
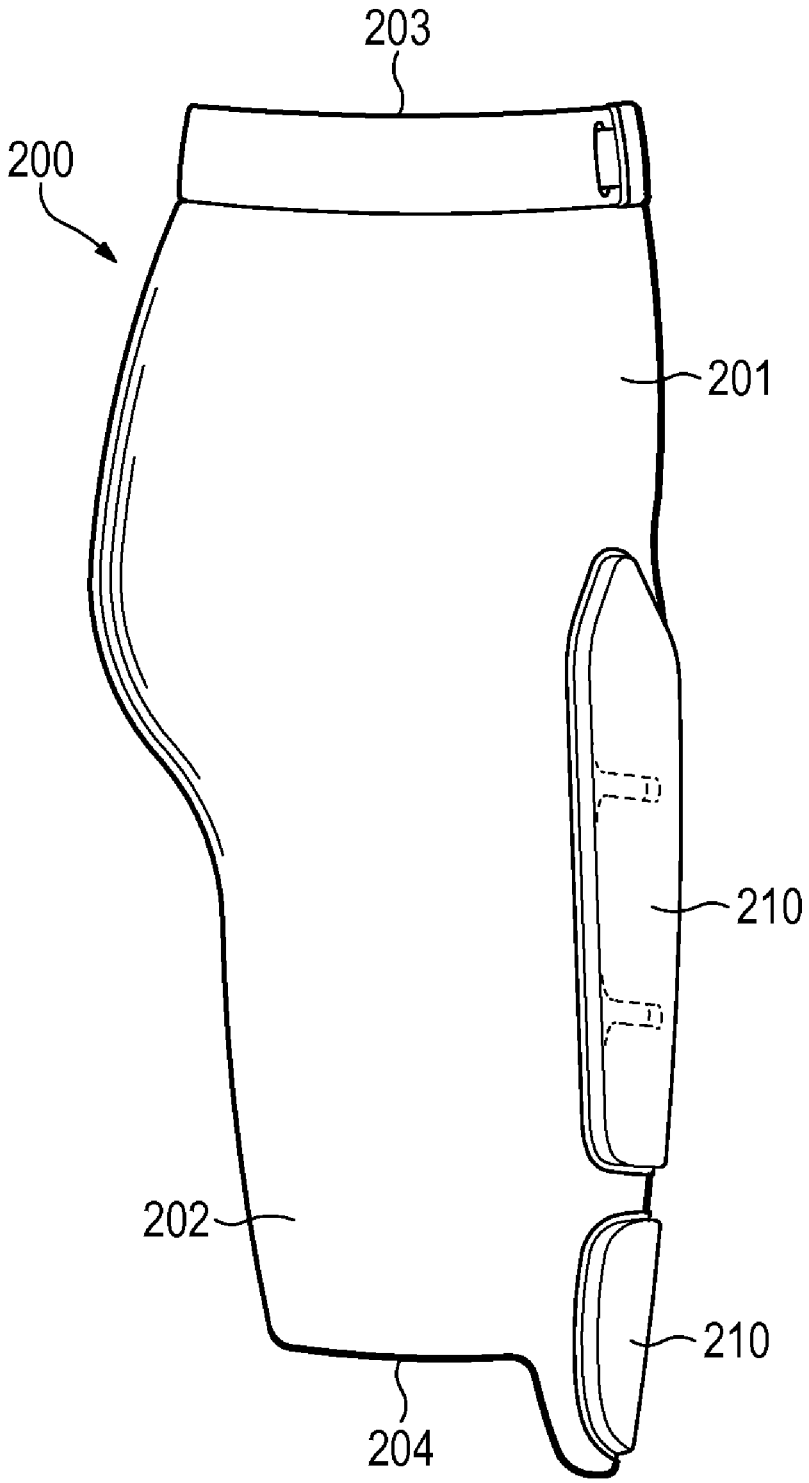
Figure 6:
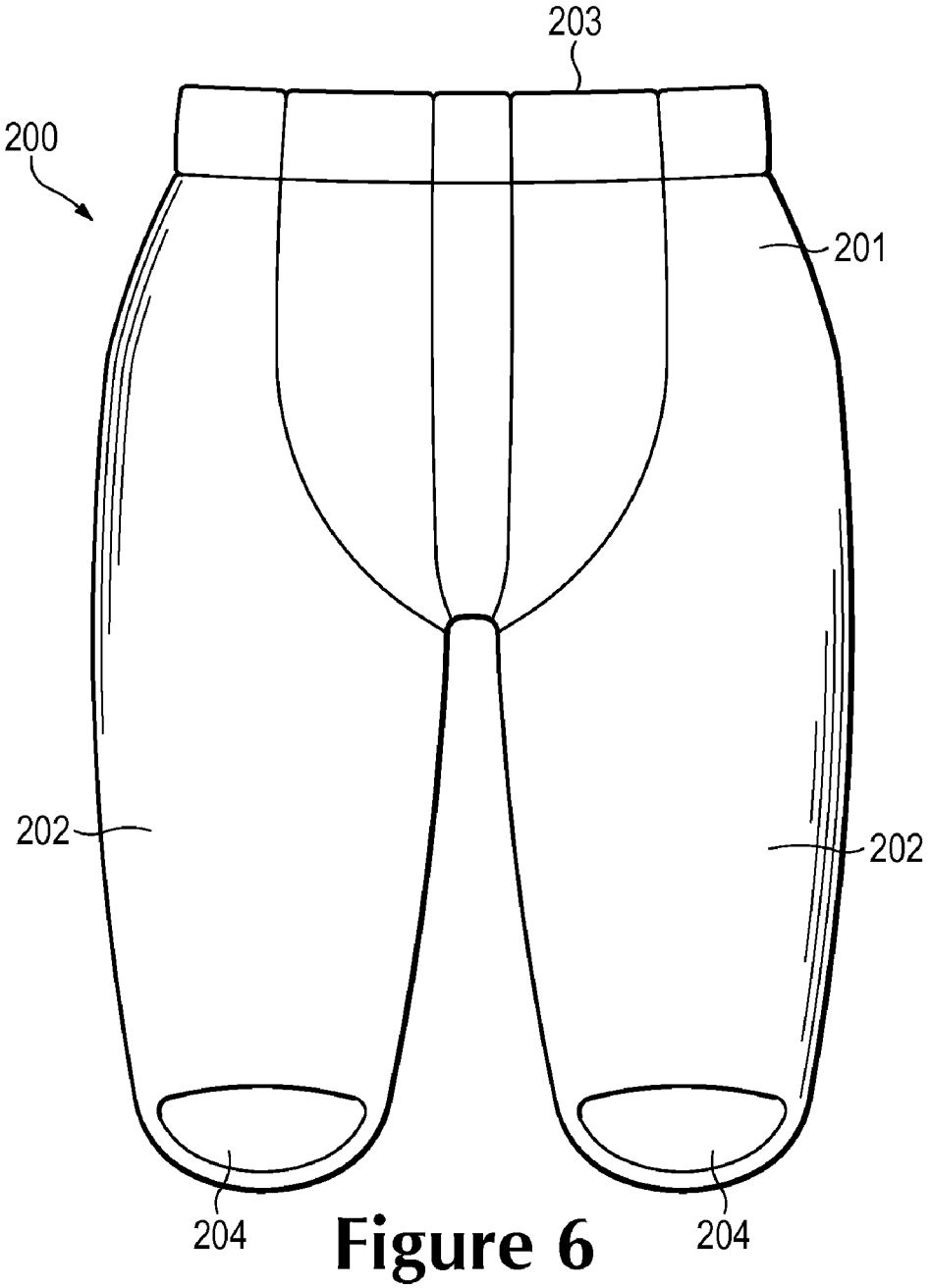
FIG. 6 is a rear elevational view of the outer garment.

With reference to FIGS. 1 and 2, an individual 10 is depicted as wearing an apparel system 100 that includes an outer garment 200 and an inner garment 300. Each of garments 200 and 300 exhibit the general configuration of a pants-type garment, which includes any of a plurality of articles of apparel that cover a portion of a pelvic area of individual 10 and may extend over legs of individual 10. Although garments 200 and 300 are each depicted as being pairs of shorts, various concepts disclosed below for garments 200 and 300 may also be applied to other pants-type garments, including pants, briefs, jeans, and underwear. The various concepts disclosed below for garments 200 and 300 may also be applied to shirt-type garments, which cover a portion of a torso area of individual 10 and may extend over arms of individual 10. Examples of shirt-type garments include long-sleeved shirts, short-sleeved shirts, tank tops, undershirts, jackets, and coats. In some configurations, articles of apparel incorporating concepts disclosed below for garments 200 and 300 may be combinations of shirt-type garments and pants-type garments, including bodysuits, leotards, unitards, and wetsuits. In addition, articles of apparel incorporating concepts disclosed below for garments 200 and 300 may have configurations that cover other areas of individual 10, such as hats, helmets, gloves, socks, and footwear, for example.

Although apparel system 100 may be worn alone or exposed, apparel system 100 may also be worn in combination with other articles of apparel (e.g., under or over other articles of apparel). Apparel system 100 may also be worn in combination with other pieces of equipment (e.g., athletic or protective equipment). In general, outer garment 200 is worn over inner garment 300, thereby positioning outer garment 200 to be exterior of inner garment 300. Whereas inner garment 300 may be worn in contact with and to cover individual 10, outer garment 200 may be worn in contact with and to cover inner garment 300. That is, inner garment 300 is generally positioned between individual 10 and outer garment 300. Depending upon various factors (e.g., sport, activity, weather, preferences), the other articles of apparel or pieces of equipment may be worn (a) between inner garment 300 and individual 10, (b) between garments 200 and 300, or (c) exterior of outer garment 200. Accordingly, the configuration of apparel system 100, including each of the individual garments 200 and 300, and the manner in which apparel system 100 is worn by individual 10 may vary significantly.

Apparel system 100 incorporates various cushioning elements 210 and protective elements 310. More particularly, outer garment 200 includes cushioning elements 210, and inner garment 300 includes protective elements 310. Although cushioning elements 210 and protective elements 310 may be utilized individually to impart padding, cushioning, or otherwise distribute or attenuate impact forces, thereby imparting protection to individual 10, elements 210 and 310 may also operate cooperatively to impart protection to individual 10. For example, some cushioning elements 210 may overlap, extend over, or otherwise coincide with the positions of some protective elements 310. In areas where cushioning elements 210 extend over protective elements 310, both elements 210 and 310 may impart protection to individual 10. Additional details concerning garments 200 and 300, as well as elements 210 and 310, will be discussed below.

Outer Garment Configuration

Outer garment 200, which incorporates cushioning elements 210, is depicted individually in FIGS. 3-6 as including a pelvic region 201 and a pair of leg regions 202 that extend outward and downward from pelvic region 201. Pelvic region 201 corresponds with the pelvic area of individual 10 and extends over at least a portion of the pelvic area when worn. An upper portion of pelvic region 201 defines a waist opening 203 that extends around a waist of individual 10 when outer garment 200 is worn. Leg regions 202 correspond with a right leg and a left leg of individual 10 and cover at least a portion of the right leg and the left leg when worn. Lower portions of leg regions 202 each define a thigh opening 204 that extends around a thigh of individual 10 when outer garment 200 is worn.

Cushioning elements 210 are incorporated into various areas of outer garment 200 to impart padding, cushioning, or otherwise attenuate impact forces, thereby imparting protection to individual 10. Two lower cushioning elements 210 are located in a front area of leg regions 202 and adjacent to thigh openings 204, and two upper cushioning elements 210 are also located in the front area of leg regions 202 and extend upward and into lower areas of pelvic region 201. As discussed above, cushioning elements 210 may overlap, extend over, or otherwise coincide with the positions of some protective elements 310 of inner garment 300. Whereas the upper cushioning elements 210 coincide in location and extend over two of protective elements 310, the lower cushioning elements 210 are positioned separate from protective elements 310. In this configuration, the upper cushioning elements 210 and two of protective elements 310 cooperatively impart protection to areas of individual 10, while the lower cushioning elements 210 individually impart protection to areas of individual 10. In further configurations of apparel system 100 or outer garment 200, cushioning elements 210 may be positioned in various areas of outer garment 200, including the sides or back of leg regions 202 or in pelvic region 201, to protect specific portions (e.g., muscles, bones, joints, impact areas) of individual 10. Additionally, the quantity, shapes, sizes, and other properties of cushioning elements 210, as well as the materials utilized in cushioning elements 210, may vary significantly to provide a particular level of protection to the specific portions of individual 10.

Figure 7A:
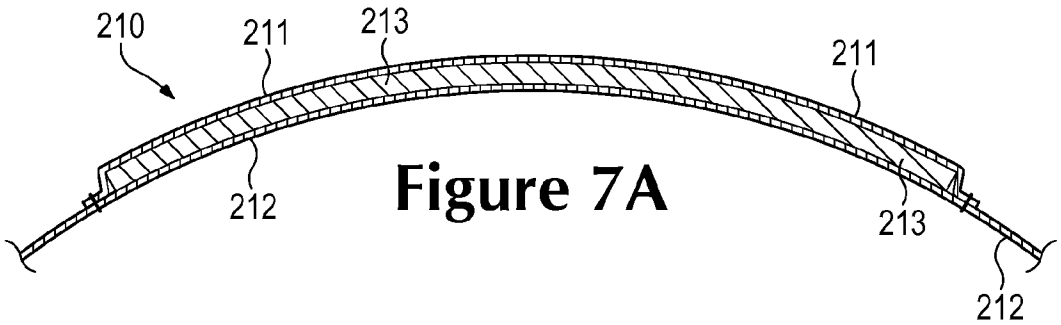
FIGS. 7A and 7B are cross-sectional views of the outer garment, as defined by section lines 7A and 7B in FIG. 3.
Figure 7B:
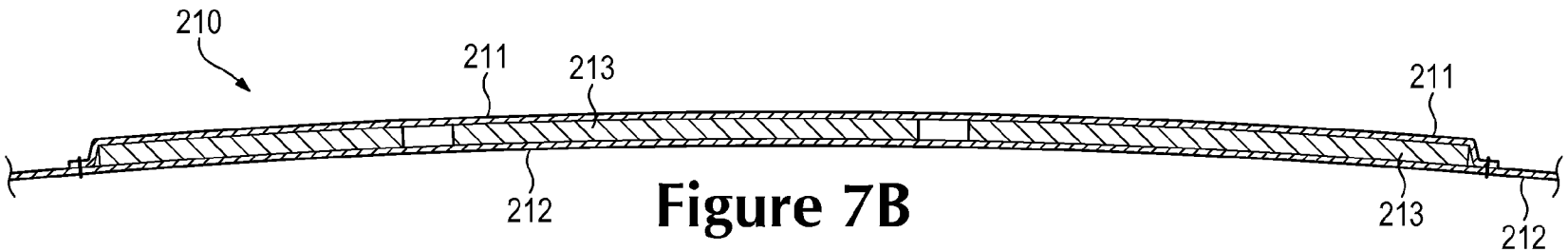
Figure 8:
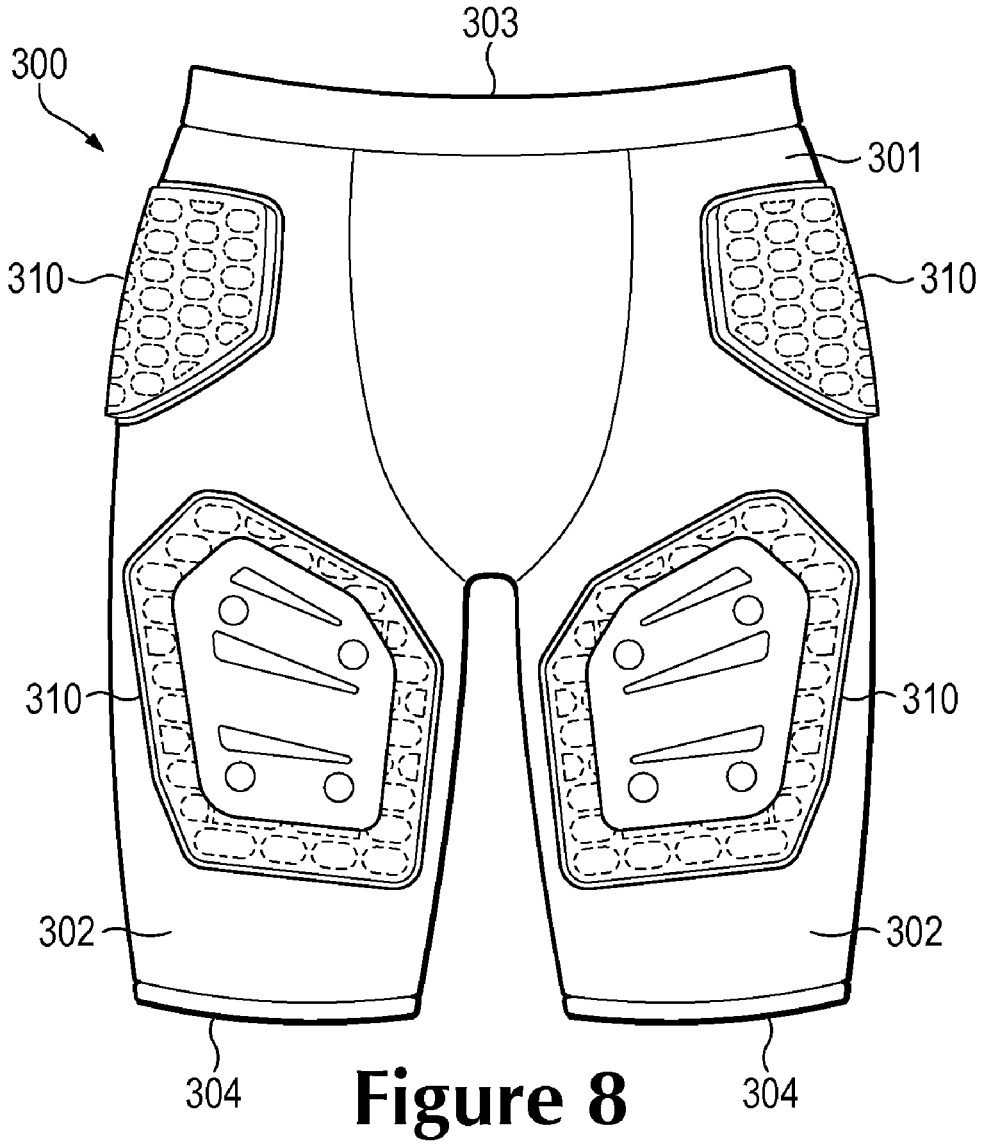
FIG. 8 is a front elevational view of the inner garment.
Figure 9:
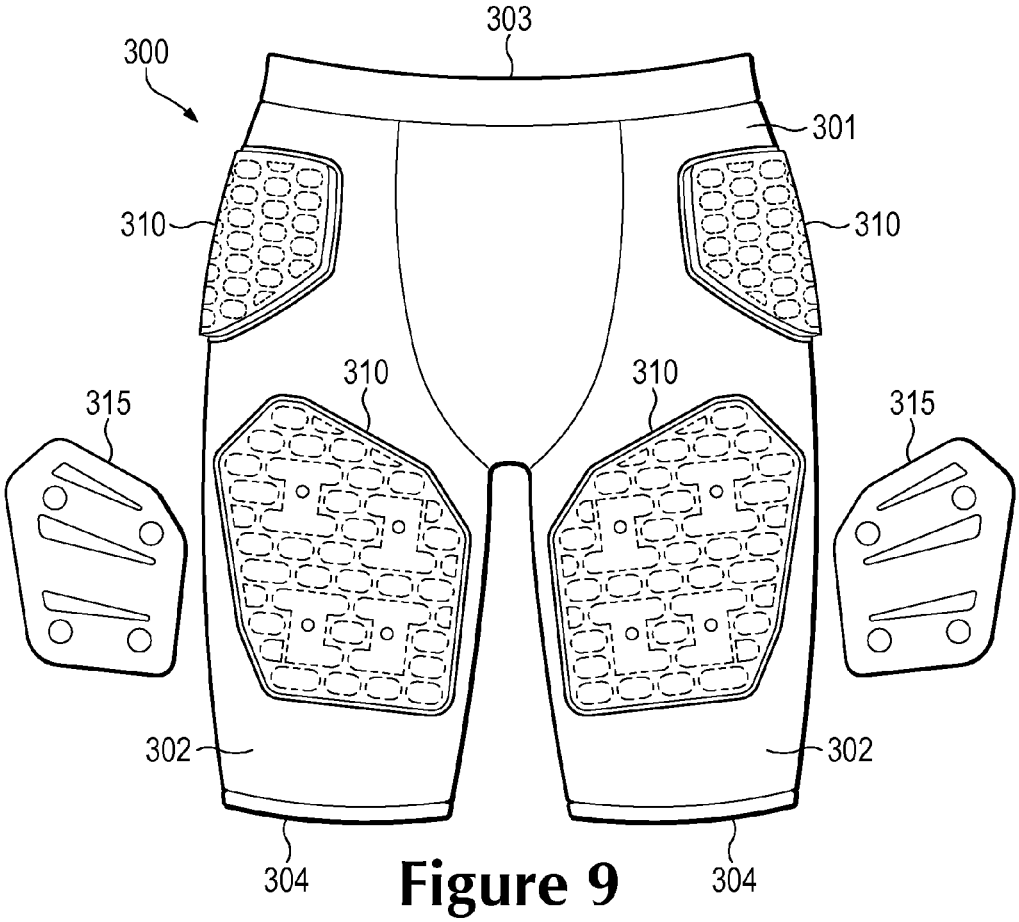
FIG. 9 is an exploded front elevational view of the inner garment.
Figure 10:
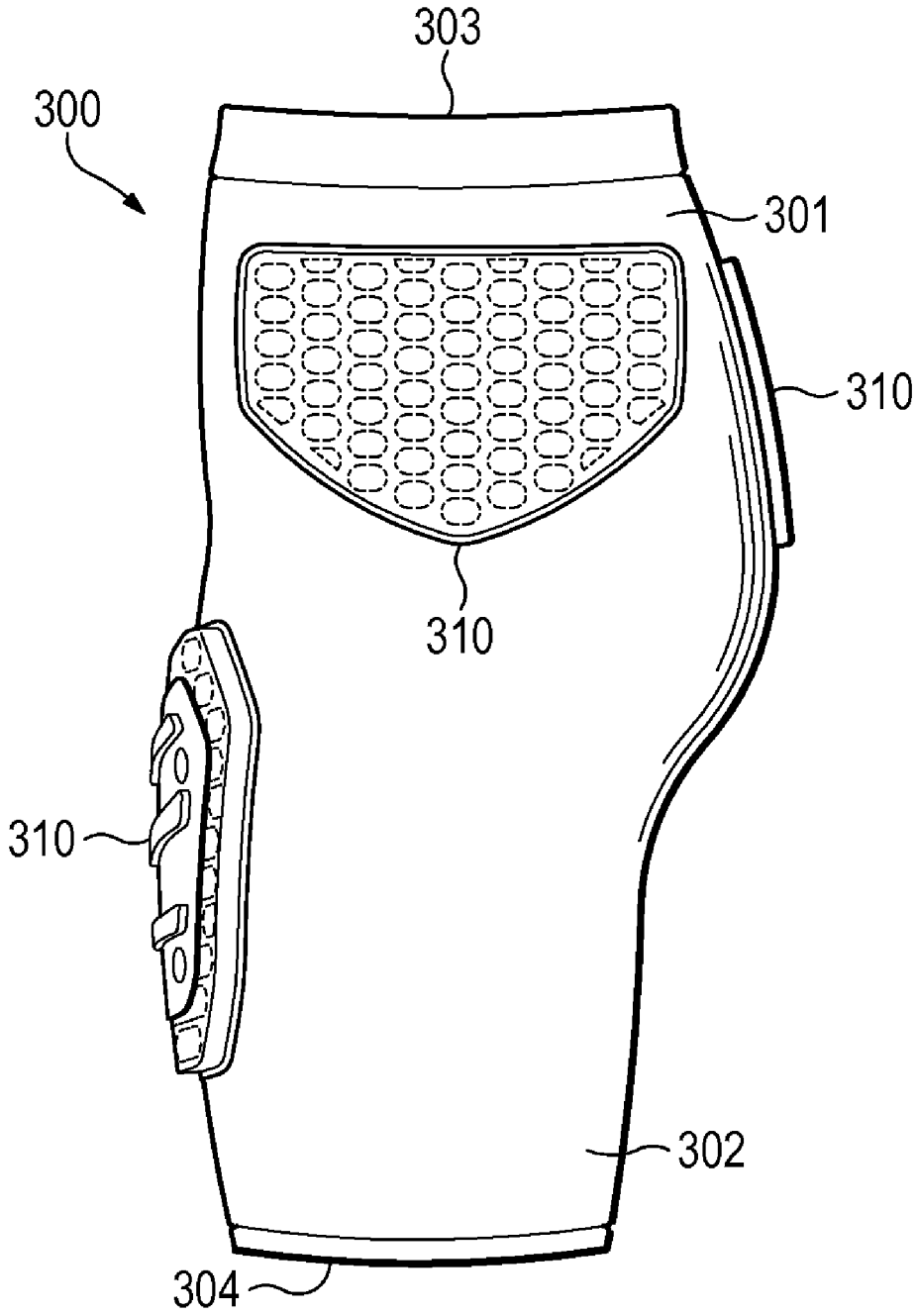
FIGS. 10 and 11 are side elevational views of the inner garment.
Figure 11:
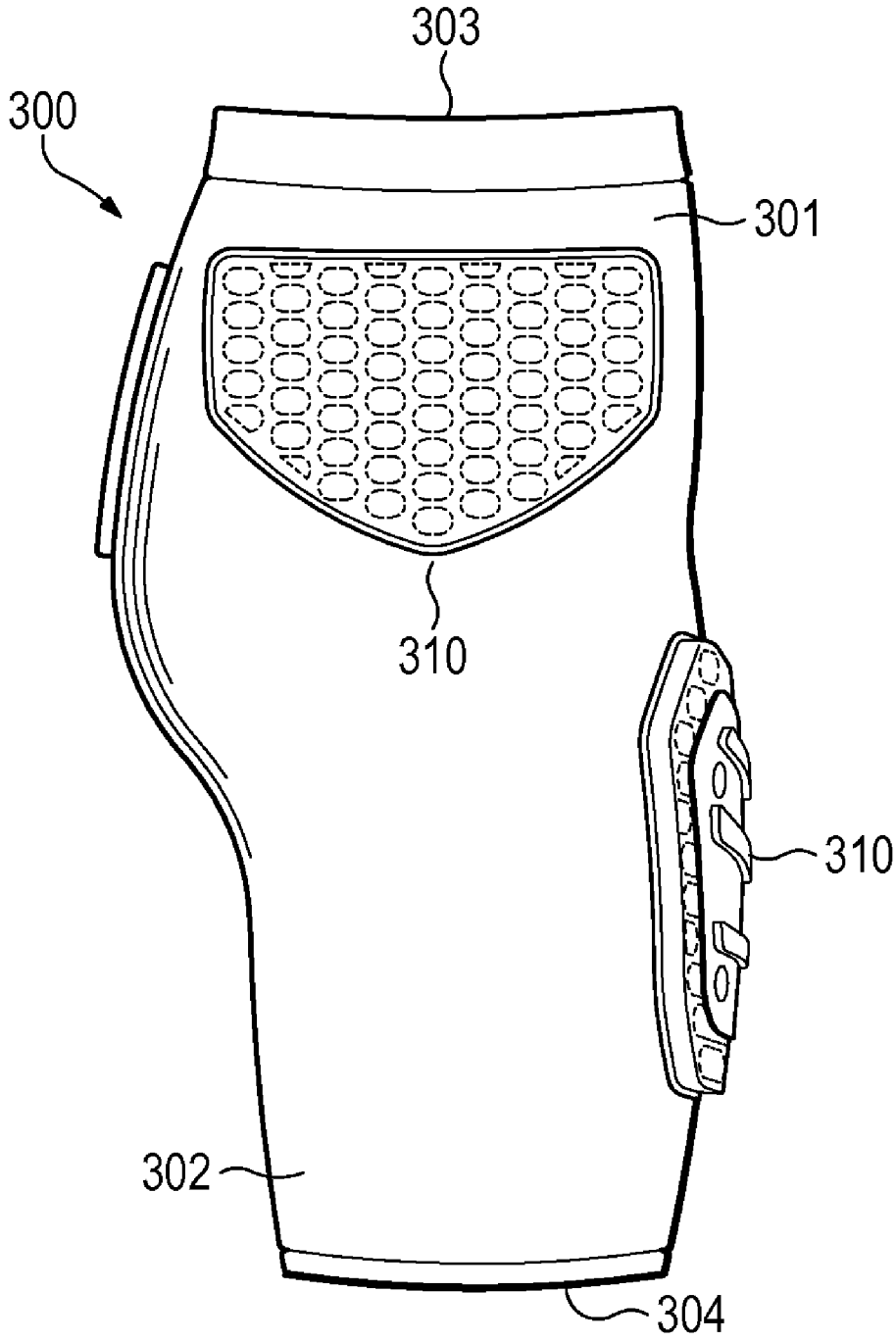
Figure 12:
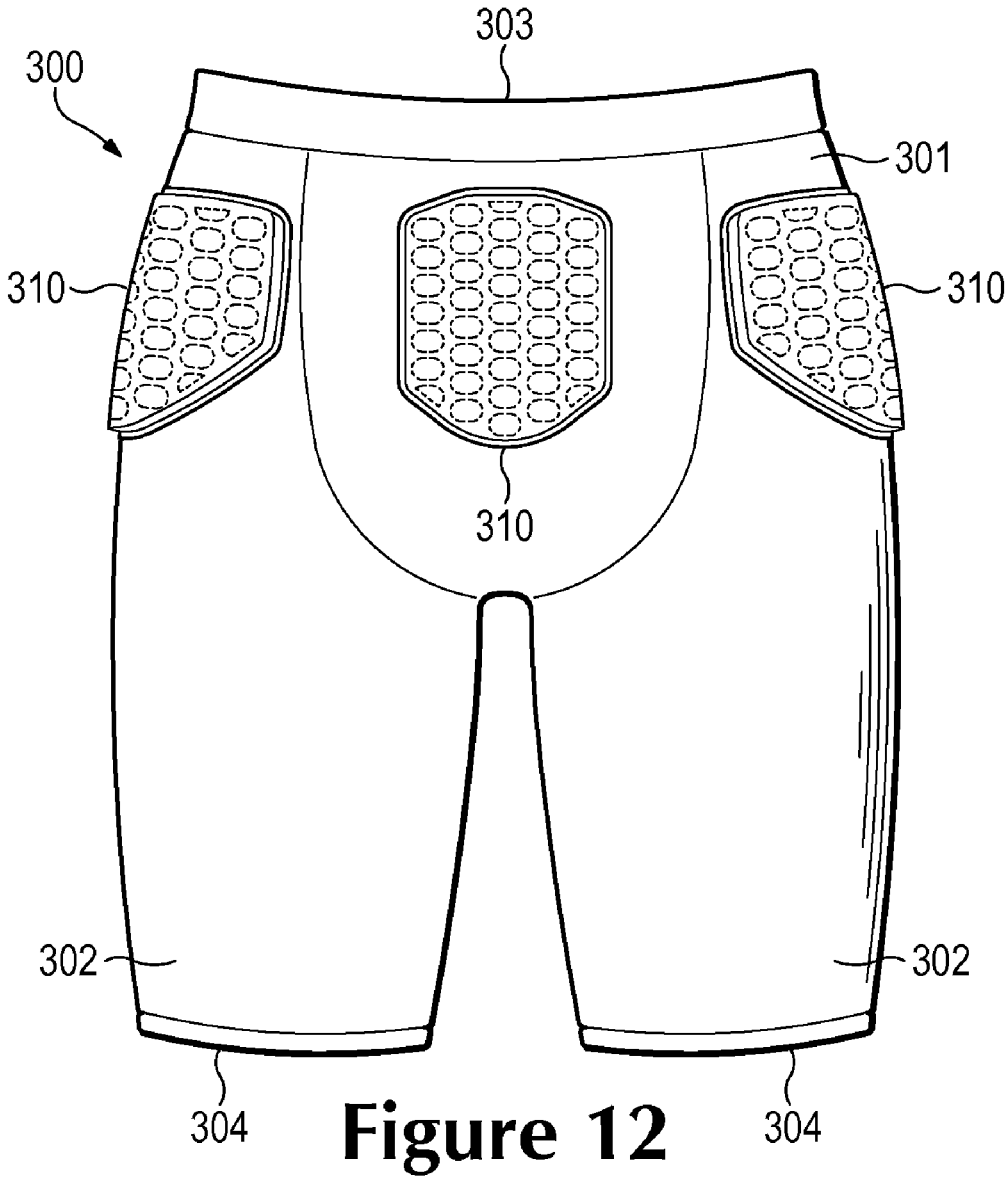
FIG. 12 is a rear elevational view of the inner garment.
Figure 13:
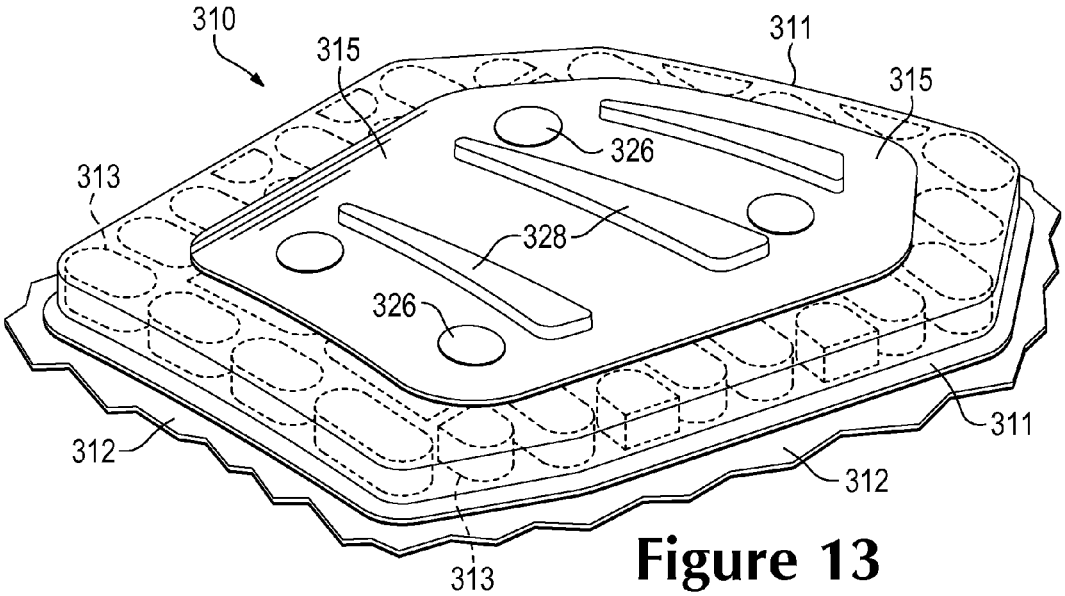
FIG. 13 is a perspective view of a protective element of the inner garment.
Figure 14:
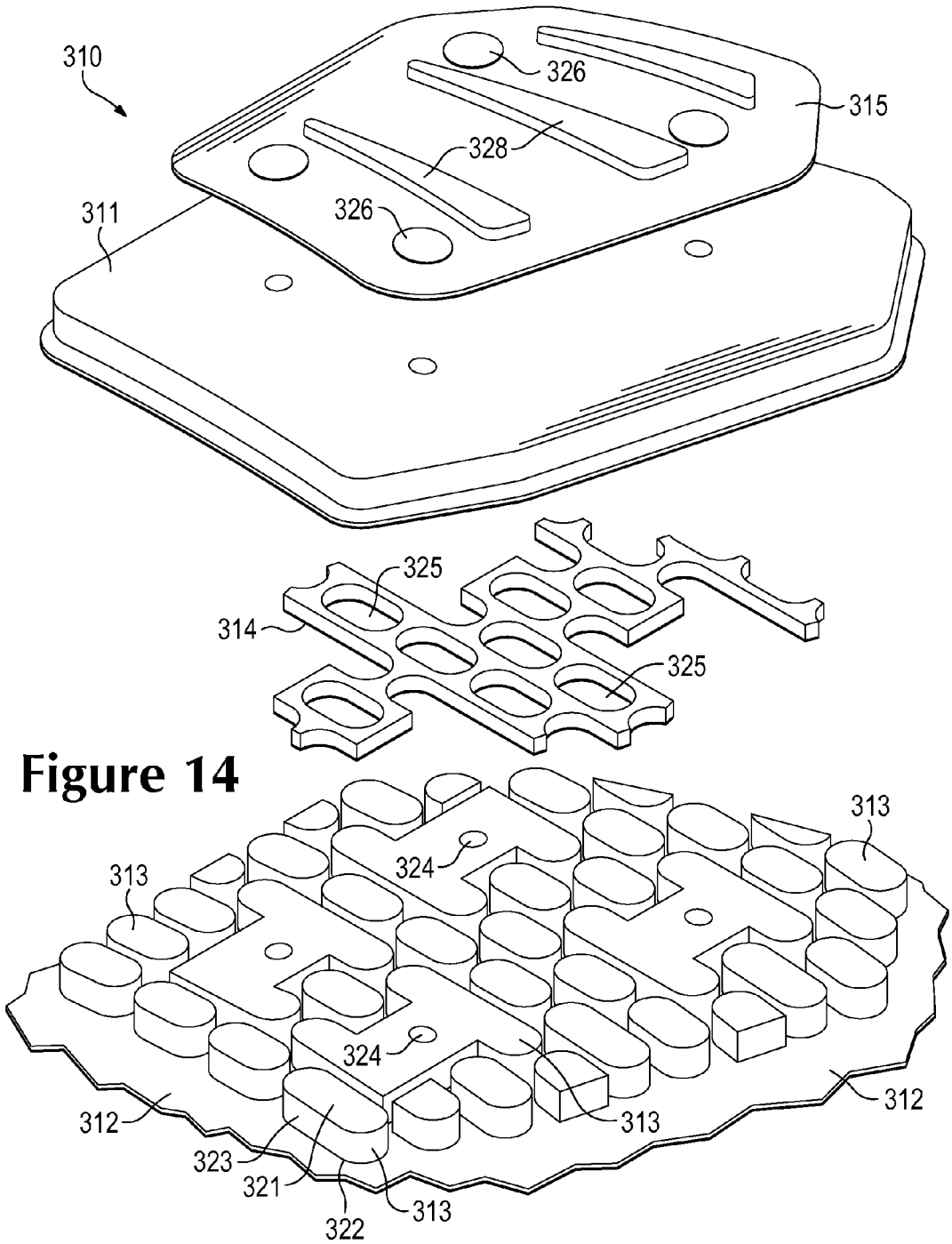
FIG. 14 is an exploded perspective view of the protective element.
Figure 15:
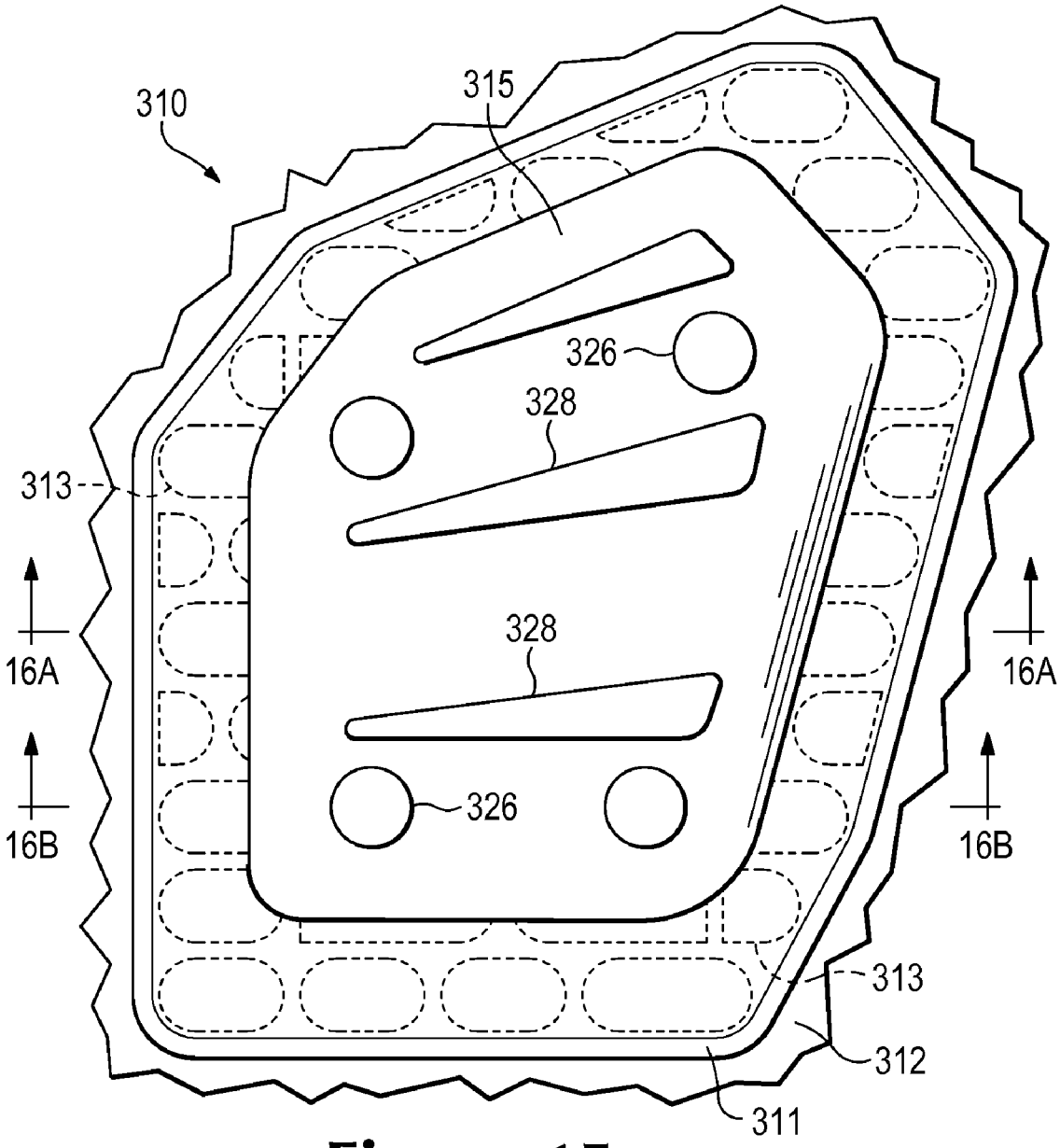
FIG. 15 is a top plan view of the protective element.

One of cushioning elements 210 is depicted in the cross-sectional views of FIGS. 7A and 7B as including a first material layer 211, a second material layer 212, and a pad component 213. In general, pad component 213 is positioned between and secured to first material layer 211 and second material layer 212. Material layers 211 and 212 cooperatively form an outer surface or covering for protective elements 210. That is, material layers 211 and 212 cooperatively form a pocket or void, in which pad component 213 is located. Whereas second material layer 212 is depicted as having a generally planar configuration, first material layer 211 extends over pad component 213 and also along sides of pad component 213 to join with second material layer 212 (e.g., through stitching, an adhesive, or thermal bonding). Although cushioning element 210 may be incorporated into outer garment 200 in a variety of ways, first material layer 211 may be positioned exterior of second material layer 212. That is, first material layer 211 may form a portion of an exterior surface of outer garment 200, whereas second material layer 212 may form a portion of an interior surface of outer garment 200. An advantage to this configuration is that cushioning element 210 protrudes outward from outer garment 200, rather than protruding inward and toward individual 10. In some configurations of outer garment 200, however, cushioning element 210 may protrude inward.

A thickness of pad component 213 may vary depending upon various factors, including the type of material utilized for pad component 213 and the desired level of protection. In general, however, the thickness of pad component 213 may range from one to fifty millimeters or more when formed from a polymer foam material. Although pad component 213 may exhibit a constant thickness between material layers 211 and 212, the thickness may vary across the width of pad component 213. For example, edges of pad component 213 may be thinner than central areas of pad component 213. Various apertures, gaps, and indentations may also be formed in pad component 213 to enhance flexibility and breathability.

A variety of materials may be utilized for first material layer 211 and second material layer 212, including various textiles, polymer sheets, leather, or synthetic leather, for example. Combinations of these materials (e.g., a polymer sheet bonded to a textile) may also be utilized for material layers 211 and 212. Although material layers 211 and 212 may be formed from the same material, each of material layers 211 and 212 may also be formed from different materials. With regard to textiles, material layers 211 and 212 may be formed from knitted, woven, or non-woven textile elements that include rayon, nylon, polyester, polyacrylic, cotton, wool, or silk, for example. Moreover, the textiles may be non-stretch, may exhibit one-directional stretch, or may exhibit multi-directional stretch. Accordingly, a variety of materials are suitable for first material layer 211 and second material layer 212.

Pad components 213 may also be formed from a variety of materials, including various polymer foam materials that return to an original shape after being compressed. As an alternative to polymer foam materials, pad components 213 may also be formed as fluid-filled chambers. Examples of suitable polymer foam materials for pad components 213 include polyurethane, ethylvinylacetate, polyester, polypropylene, and polyethylene foams. Moreover, both thermoplastic and thermoset polymer foam materials may be utilized. In some configurations of cushioning elements 210, pad components 213 may be formed from a polymer foam material with a varying density, or solid polymer or rubber materials may be utilized. Also, different pad components 213 may be formed from different materials, or may be formed from similar materials with different densities. Additional articles of apparel having features that may be utilized in outer apparel 200 or for pad components 213 are disclosed in U.S. patent application Ser. No. 11/620,950, filed 8 Jan. 2007 and entitled Athletic Garment With Articulated Body Protective Underlayer, which is entirely incorporated herein by reference.

The polymer foam materials forming pad components 213 of cushioning elements 210 attenuate impact forces to provide protection. When incorporated into apparel system 100 and outer garment 200, the polymer foam materials of pad components 213 may compress to protect a wearer from contact with other athletes, equipment, or the ground. Accordingly, cushioning elements 210 may be utilized to provide protection to areas of individual 10 that are covered by cushioning element 210. Additionally, some components of protective elements 310 may include relatively hard or rigid materials (e.g. plates). As discussed above, cushioning elements 210 may overlap, extend over, or otherwise coincide with the positions of some protective elements 310 of inner garment 300, and cushioning elements 210 may be utilized to provide protection to other athletes or individuals from the relatively hard or rigid materials of protective elements 310.

Inner Garment Configuration

Inner garment 300, which incorporates protective elements 310, is depicted individually in FIGS. 8-12 as including a pelvic region 301 and a pair of leg regions 302 that extend outward or downward from pelvic region 301. Pelvic region 301 corresponds with the pelvic area of individual 10 and extends over at least a portion of the pelvic area when worn. Pelvic region 301 also corresponds with pelvic region 201 of outer garment 200 and is generally located between pelvic region 201 and individual 10 when worn. An upper portion of pelvic region 301 defines a waist opening 303 that extends around a waist of individual 10 when outer garment 300 is worn. Leg regions 302 correspond with a right leg and a left leg of individual 10 and cover at least a portion of the right leg and the left leg when worn. Leg regions 302 also correspond with leg regions 202 of outer garment 200 and are generally located between leg regions 202 and individual 10 when worn. Lower portions of leg regions 302 each define a thigh opening 304 that extends around a thigh of individual 10 when inner garment 300 is worn.

Protective elements 310 are incorporated into various areas of inner garment 300 to impart padding, cushioning, or otherwise attenuate impact forces, thereby imparting protection to individual 10. More particularly, two of protective elements 310 are located in a front area of leg regions 302, two of protective elements 310 are located on sides of pelvic region 301, and one of protective elements 310 is in a back of pelvic region 301. In further configurations of apparel system 100 or inner garment 300, protective elements 310 may be positioned in various areas of inner garment 300, including the sides or back of leg regions 302 or other areas of pelvic region 301, to protect specific portions (e.g., muscles, bones, joints, impact areas) of individual 10. Additionally, the quantity, shapes, sizes, and other properties of protective elements 310, as well as the materials utilized in protective elements 310, may vary significantly to provide a particular level of protection to the specific portions of individual 10.

As discussed above, cushioning elements 210 of outer garment 200 may overlap, extend over, or otherwise coincide with the positions of some protective elements 310. Although outer garment 200 may cover substantially all of inner garment 300 and the various protective elements 310, only the upper cushioning elements 210 coincide in location and extend over the two protective elements 310 in the front area of leg regions 302. In further configurations of apparel system 100, however, additional cushioning elements 210 may extend over other protective elements 310.

Protective Element Configuration

An example configuration for one of protective elements 310 is depicted in FIGS. 13-17B as including a first material layer 311, a second material layer 312, a plurality of pad components 313, a frame 314, and a plate 315. In general, pad components 313 and frame 314 are positioned between first material layer 311 and second material layer 312. Although pad components 313 are secured to first material layer 311 and second material layer 312, frame 314 is unsecured to each of first material layer 311, second material layer 312, and pad components 313. Additionally, plate 315 is located at an exterior of protective element 310 (i.e., located exterior of first material layer 311). Although each protective element 310 in the front area of leg regions 302 incorporate one of plates 315, further plates are absent from other protective elements 310. In further configurations, additional plates 315 may be utilized in the other protective elements 310.

First material layer 311 and second material layer 312 cooperatively form an outer surface or covering for protective element 310, with plate 315 also forming a portion of the outer surface. That is, first material layer 311 and second material layer 312 cooperatively form a pocket or void, in which pad components 313 and frame 314 are located. Whereas second material layer 312 is depicted as having a generally planar configuration, first material layer 311 extends over pad components 313 and frame 314 and also along sides of pad components 313 to join with second material layer 312 (e.g., through stitching, an adhesive, or thermal bonding). Although protective element 310 may be incorporated into inner garment 300 in a variety of ways, first material layer 311 may be positioned exterior of second material layer 312. That is, first material layer 311 may form a portion of an exterior surface of inner garment 300, whereas second material layer 312 may form a portion of an opposite interior surface of inner garment 300. An advantage to this configuration is that protective element 310 protrudes outward from inner garment 300, rather than protruding inward and toward individual 10. In some configurations of inner garment 300, however, protective element 310 may protrude inward. Any of the various materials discussed above for material layers 211 and 212 may be utilized for first material layer 311 and second material layer 312.

Pad components 313 are located between and secured to each of material layers 311 and 312. Each of pad components 313 has a first surface 321 secured to first material layer 311, an opposite second surface 322 secured to second material layer 312, and a side surface 323 that extends between surfaces 321 and 322. Although the shapes of pad components 313 may vary significantly, many of surfaces 321 and 322 are depicted as having an elliptical or generally elongate shape with rounded end areas, and side surface 323 extends in a generally straight fashion between surfaces 321 and 322. Pad components 313 are spaced evenly from each other and arranged in offset rows. Given that protective element 310 is depicted as having a generally pentagonal configuration, various pad components 313 around a perimeter of protective element 310 exhibit a truncated or partial configuration. Some of pad components 313 also define apertures 324 that receive elements for securing plate 315, and these pad components may be larger than other pad components 315. A variety of materials may be utilized for pad components 313, including any of the various materials discussed above for pad component 213, such as polymer foam materials and fluid-filled chambers.

Each of pad components 313 are depicted as having the same thickness (i.e., distance between surfaces 321 and 322), which may range from one to fifty millimeters or more when formed from a polymer foam material. As an alternative, pad components 313 may exhibit varying thicknesses. For example, a group of pad components 313 located in a central area of protective element 310 may exhibit a maximum thickness, a group of pad components 313 located around the central area may exhibit a medium thickness, and a group of pad components 313 located adjacent to a periphery of protective element 310 may exhibit a minimum thickness. A configuration of a cushioning element with varying thicknesses is disclosed in U.S. Provisional Patent Application Ser. No. 61/158,653, filed 9 Mar. 2009 and entitled Cushioning Elements For Apparel And Other Products, which is entirely incorporated herein by reference.

Frame 314 is located between each of material layers 311 and 312. In contrast with pad components 313, frame 314 is unsecured to each of first material layer 311 and second material layer 312, and frame 314 is also unsecured to pad components 313. This configuration permits frame 314 to float or otherwise move relative to first material layer 311, second material layer 312, and pad components 313. Frame 314 defines a plurality of apertures 325 having the general shape of pad components 313. Given this configuration, frame 314 extends around and between various pad components 313. In areas where frame 314 is present, the combination of pad components 313 and frame 314 effectively forms a foam layer within protective element 310. Although the dimensions of apertures 325 may substantially match the dimensions of pad components 313, frame 314 may also be formed such that a gap extends between edges of apertures 325 and side surfaces 233 of pad components 313. Any of the variety of materials discussed above as being suitable for pad components 213 and 313 may also be utilized for frame 314.

Frame 314 is depicted as being located in the central area of protective element 310. As an alternative, frame 314 may extend (a) throughout protective element 310 and define apertures 325 that extend around all of pad components 313, (b) around other pad components 313, or (c) through other areas of protective element 310. Additionally, frame 314 may extend to the periphery of protective element 310 in some areas, but not in other areas. Accordingly, the portions of protective element 310 into which frame 314 extends may vary significantly.

Figure 16A:
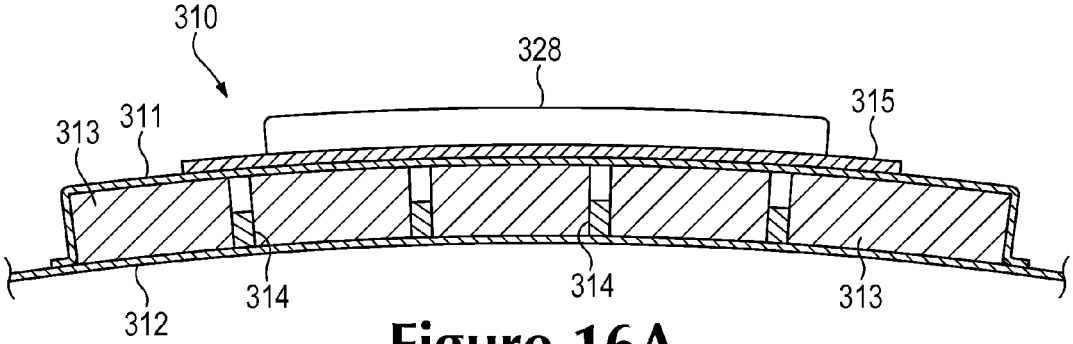
FIGS. 16A and 16B are cross-sectional views of the protective element, as defined by section lines 16A and 16B in FIG. 15.
Figure 16B:
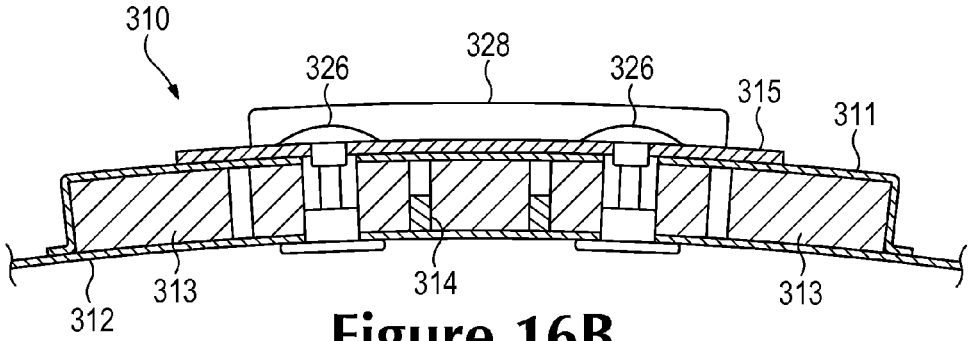
Figure 17A:
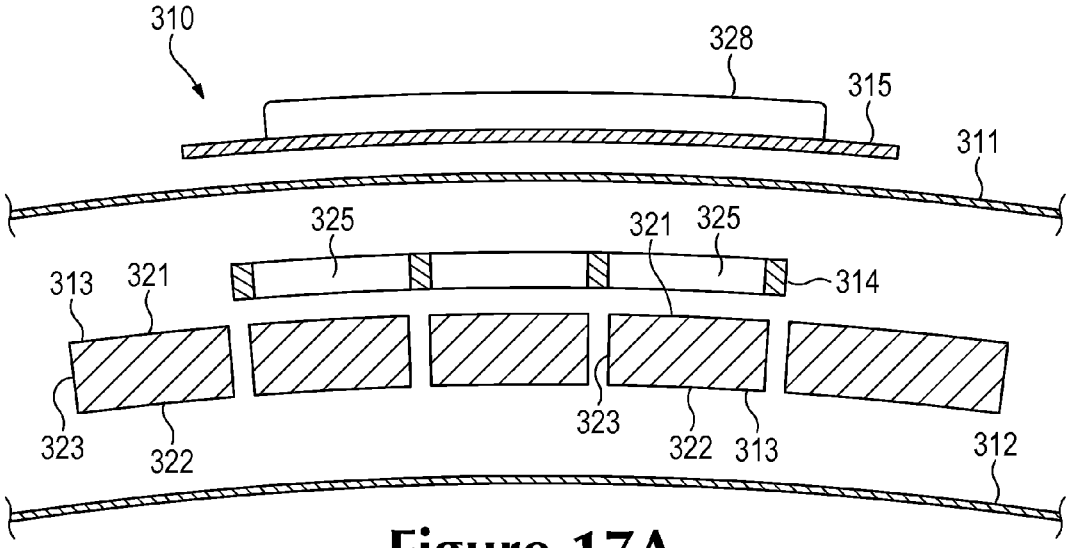
FIGS. 17A and 17B are exploded cross-sectional views respectively corresponding with the cross-sectional views of FIGS. 16A and 16B.
Figure 17B:
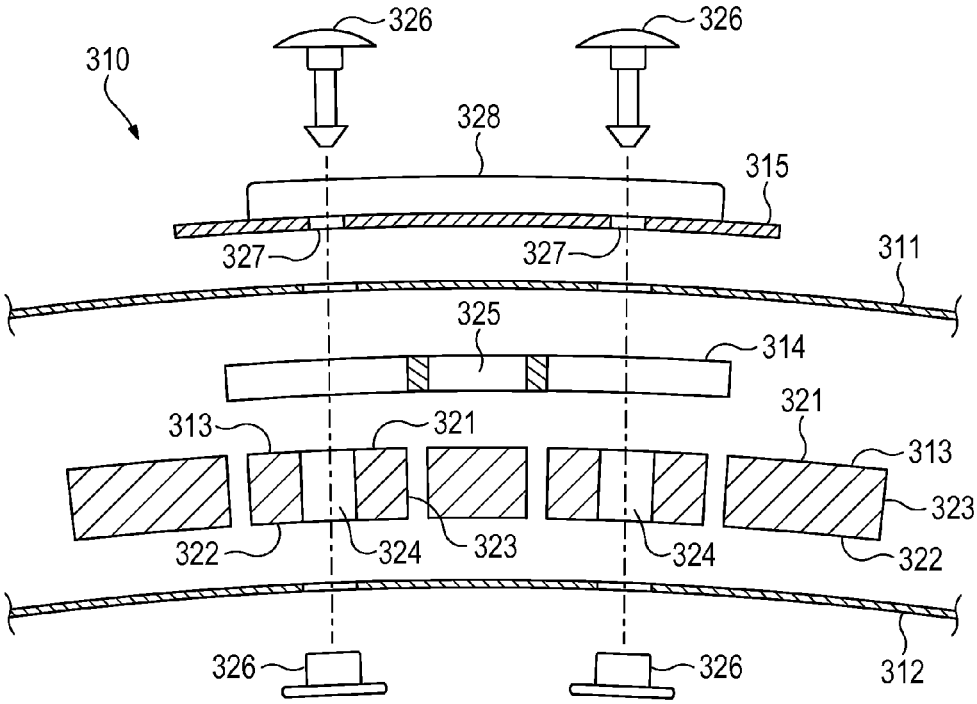

Referring to the cross-sectional views of FIGS. 16A and 16B, for example, frame 314 is depicted as exhibiting lesser thickness than each of pad components 313. An advantage of this configuration is that frame 314 may move relative to material layers 311 and 312, thereby enhancing the flexibility of protective element 310. As an example, frame 314 may have a thickness of approximately two millimeters in a configuration wherein the pad components 313 exhibit a thickness of five millimeters. In other configurations, the thickness of frame 314 may range from one to fifty millimeters or more. Although frame 314 may exhibit lesser thickness than pad components 313, frame 314 may also be thicker than pad components 313.

Plate 315 is positioned exterior of material layers 311 and 312, pad components 313, and frame 314. Whereas pad components 313 and frame 314 are located between material layers 311 and 312, plate 315 is located on an opposite side of first material layer 311 and forms a portion of an exterior surface of inner garment 300 and protective element 310. As described in greater detail below, plate 315 has a semi-rigid structure that distributes impact forces over pad components 313 to impart protection to individual 10 or another wearer.

Various securing elements 326 are utilized to secure plate 315 to protective element 310. Securing elements 326 extend through apertures 327 in plate 315 and also extend through corresponding apertures 324 in selected pad components 313, as well as holed in material layers 311 and 312. Although securing elements 326 are depicted as having the general configuration of rivets, various snap-fit securing mechanisms, adhesive or thermal bonding, or stitching may be utilized to join plate 315. In some configurations, plate 315 may also be secured with a hook-and-loop fastener that permits plate 315 to be separated, repositioned, or replaced.

Plate 315 has an overall curved configuration that generally conforms with a shape of individual 10. Given that protective element 300 may be utilized to protect a thigh of individual 10, plate 315 may exhibit a curvature that corresponds with the thigh. Additionally, plate 315 may include various ribs 328 that enhance rigidity. In further configurations, plate 315 may have a variety of other features that enhance the comfort or protective properties of apparel system 100 or protective element 300. For example, plate 315 may define a plurality of apertures that enhance breathability or flexibility, plate 315 may be formed from multiple materials that vary the rigidity or flexibility in different areas, or plate 315 may have a varying thickness that also vary the rigidity or flexibility in different areas.

Plate 315 is depicted as having lesser area than first material layer 211. In this configuration, some of pad components 313 are located adjacent to plate 315 (i.e., covered by plate 315), and some of pad components 313 are located around a periphery of plate 315. That is, plate 315 only covers a central portion of pad components 313, but effectively exposes peripheral portions of pad components 313. Forming plate 315 in this manner imparts a varying thicknesses to protective element 310. An advantage of thee varying thicknesses relates to the comfort of apparel system 100 and the integration of inner garment 300 with other articles of apparel (e.g., outer garment 200) or other articles of equipment. The lesser thickness of the periphery of protective element 310 imparts a lower profile at the periphery. Given the lower profile, portions of protective element 310 at the periphery may be less noticeable to individual 10 and may interfere less with the other articles of apparel or equipment. Moreover, plate 315 may have a conventional size, but the protective properties of pad components 313 may extend beyond plate 315 to cover further and larger areas of individual 10.

As a comparison with the compressible polymer foam materials forming pad components 313 and frame 314, plate 315 may be formed from a semi-rigid or rigid polymer material with greater rigidity and density than the polymer foam material. Examples of suitable polymer materials for plate 315 include polyethylene, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate 315. In some configurations, plate 315 may also be formed from metal materials (e.g., aluminum, titanium, steel) or may include metal elements that enhance the strength and rigidity of plate 315. Accordingly, a variety of materials may be utilized for plate 315.

Plate 315 and pad components 314 cooperatively impart protection to individual 10. An impact force contacting plate

315, for example, is distributed over many of pad components 314, which cushion or otherwise attenuate the impact force. That is, the rigid or semi-rigid polymer material forming plate 315 distributes impact forces, and the compressible polymer foam materials of pad components 313 impart cushioning or otherwise attenuate the impact forces. When incorporated into apparel system 100 cushioning elements 210 from outer garment 200 impart further attenuation of the impact forces and may assist with protecting other individuals.

In addition to distributing and attenuating impact forces, protective element 310 has an advantage of simultaneously providing one or more of breathability, a relatively low overall mass, and launderability. When used for athletic activities, individual 10 may perspire and generate excess heat. By utilizing a permeable textile for material layers 311 and 312 and also forming gaps between adjacent pad components 313 and areas between pad components 313 and frame 314, areas for air to enter the apparel and for moisture to exit the apparel are formed through protective element 310. More particularly, air and moisture may pass through material layers 311 and 312, between pad components 313 in areas where frame 314 is absent, and between pad components 313 and frame 314 in areas where frame 314 is present to impart breathability to areas of the apparel having protective element 310. Moreover, the materials and structure discussed above for protective element 310 impart a low overall mass to protective element 310. Furthermore, the materials and structure discussed above for protective element 310 permits protective element 310 to be laundered without significant shrinkage or warping, even when temperatures associated with commercial laundering processes are utilized. Accordingly, protective element 310 may simultaneously provide impact force distribution, impact force attenuation, breathability, a relatively low overall mass, and launderability to apparel system 100.

The combination of garments 200 and 300 effectively form a layered structure that includes material layers 211, 212, 311, and 312; pad components 213 and 313; frame 314; and plate 315. The layered structure has a configuration wherein plates 315 are located between polymer foam materials. More particularly, plates 315 are located between each of pad components 213 and 313, as well as frame 314. As discussed above, cushioning elements 210 may overlap, extend over, or otherwise coincide with the positions of some protective elements 310 of inner garment 300, and cushioning elements 210 may be utilized to provide protection to other athletes or individuals from the relatively hard or rigid materials of protective elements 310. In apparel system 100, cushioning elements 210 overlap only the protective elements 310 that incorporate plates 315. Given that plates 315 from relatively hard or rigid materials, cushioning elements 210 may be utilized to provide protection to other athletes or individuals from plates 315. Moreover, pad components 213 may have a greater area than plates 315 such that pad components 213 completely cover plates 315. Even if elements 210 and 310 move relative to each other, the larger pad components 213 may remain in an overlapping configuration with plates 315 to continue providing protection to other athletes or individuals from plates 315.

Further Configurations

Aspects of protective element 310 may vary, depending upon the intended use for protective element 310, the types of apparel that protective element 310 is used in, and the location within the apparel, for example. Moreover, changes to the dimensions, shapes, and materials utilized within protective element 310 may vary the overall properties of protective element 310. That is, by changing the dimensions, shapes, and materials utilized within protective element 310, the compressibility, impact force attenuation and distribution, breathability, flexibility, and overall mass of protective element 310 may be tailored to specific purposes or types of apparel. A plurality of variations for protective element 310 are discussed below. Any of these variations, as well as combinations of these variations, may be utilized to tailor the properties of protective element 310 to an intended use or particular product. Moreover, any of the various configurations disclosed in U.S. Provisional Patent Application Ser. No. 61/158,653, which was previously entirely incorporated herein by reference, may be utilized for protective element 310.

Figure 18A:
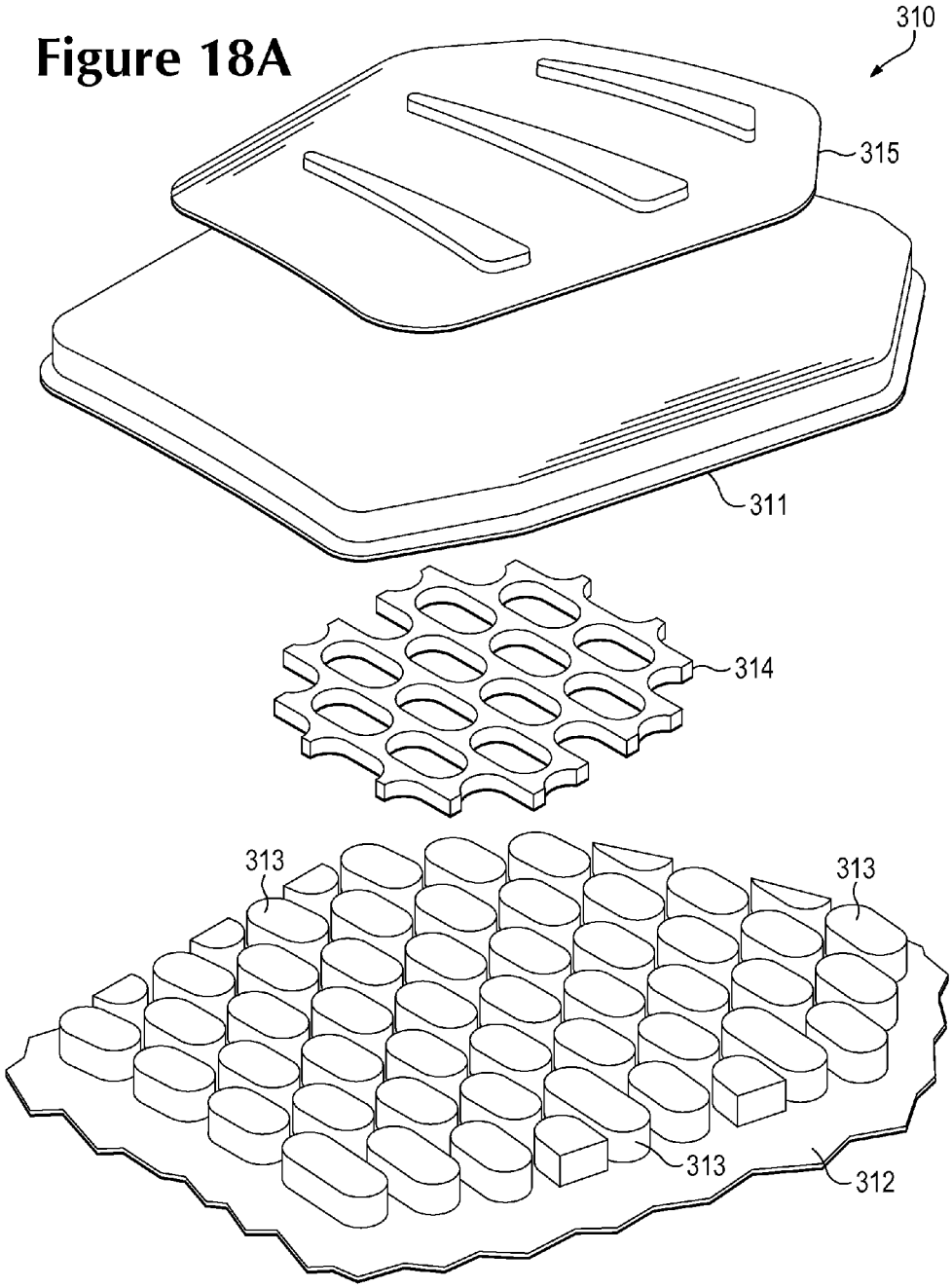
FIGS. 18A-18D are exploded perspective views corresponding with FIG. 14 and depicting further configurations of the protective element.
Figure 18B:
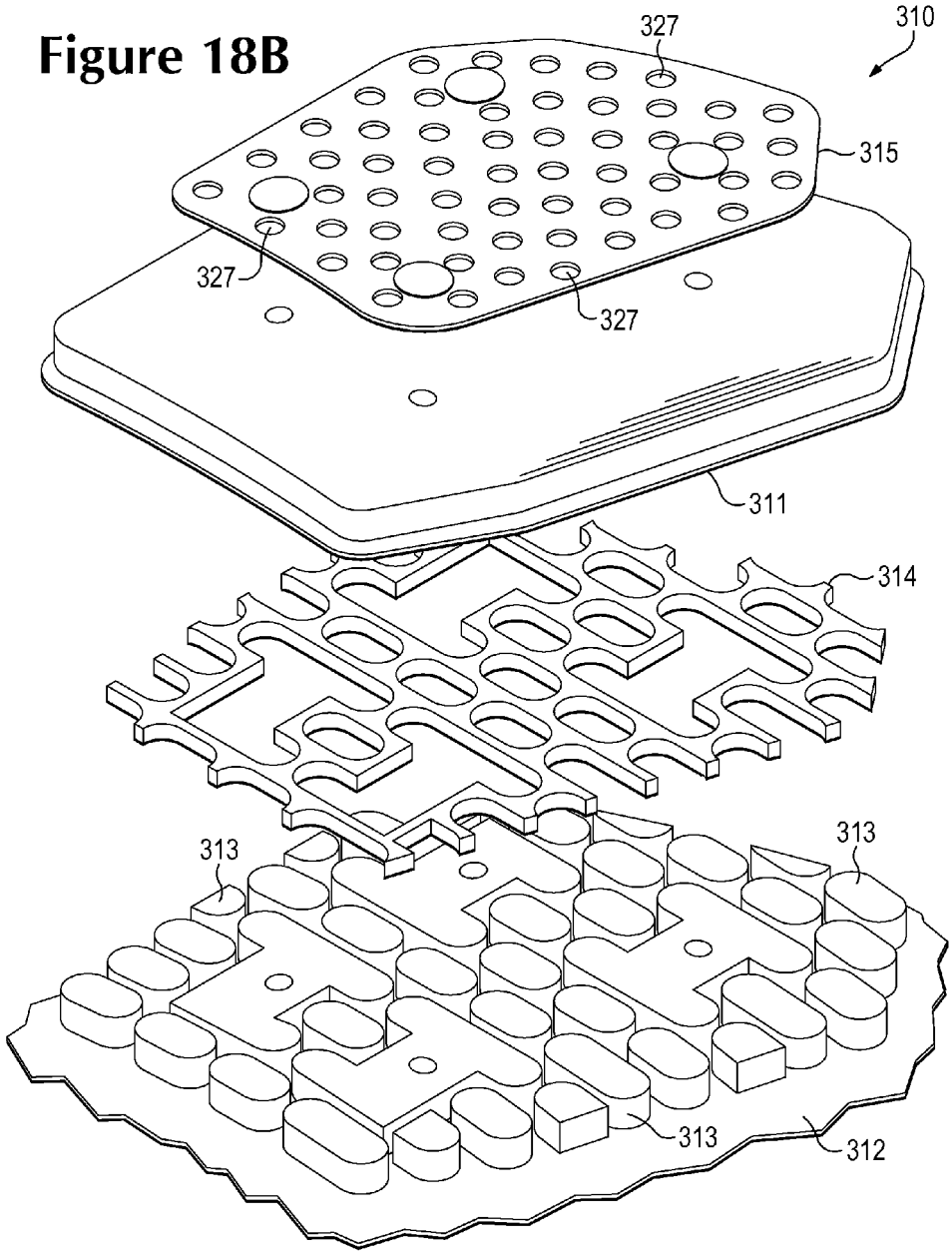
Figure 18C:
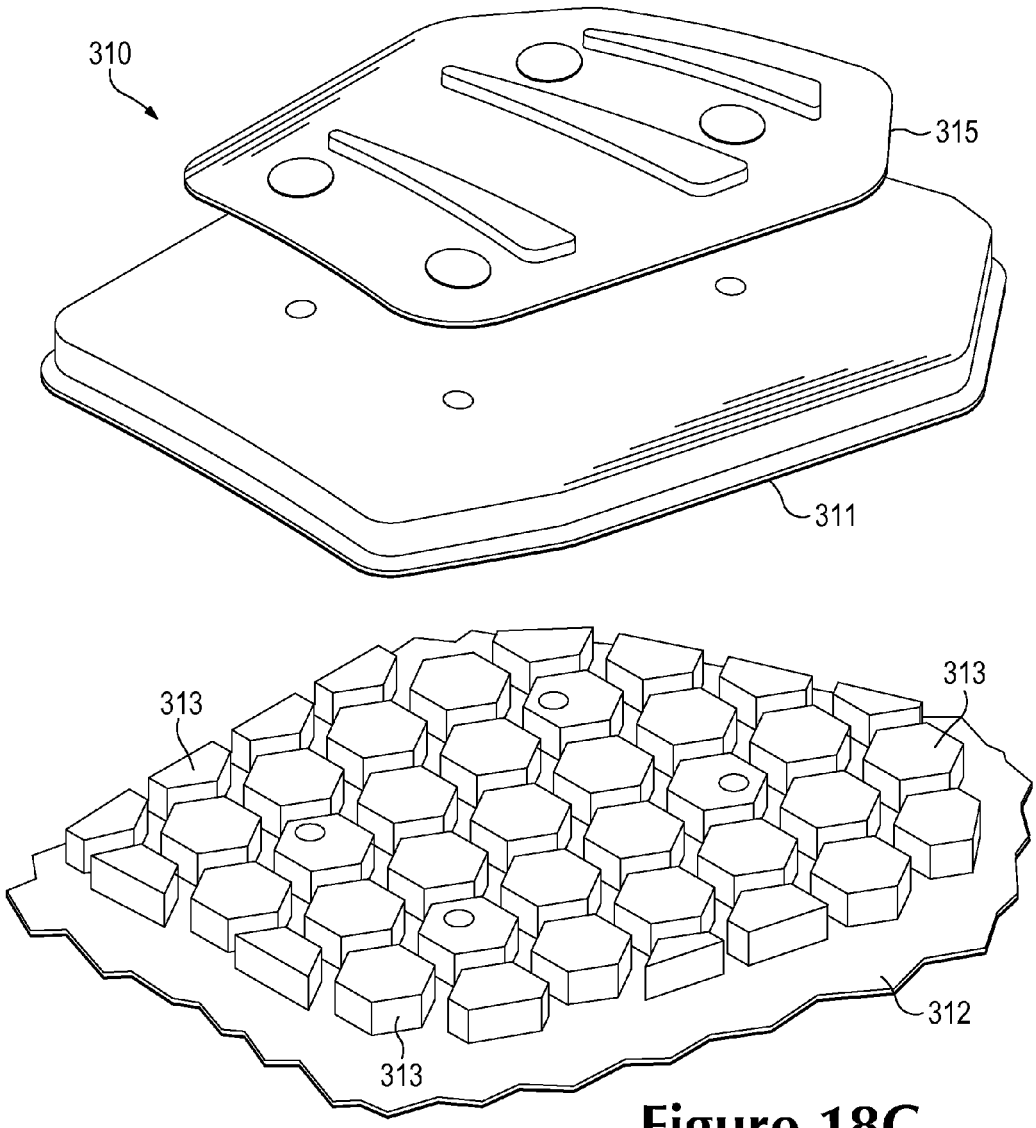
Figure 18D:
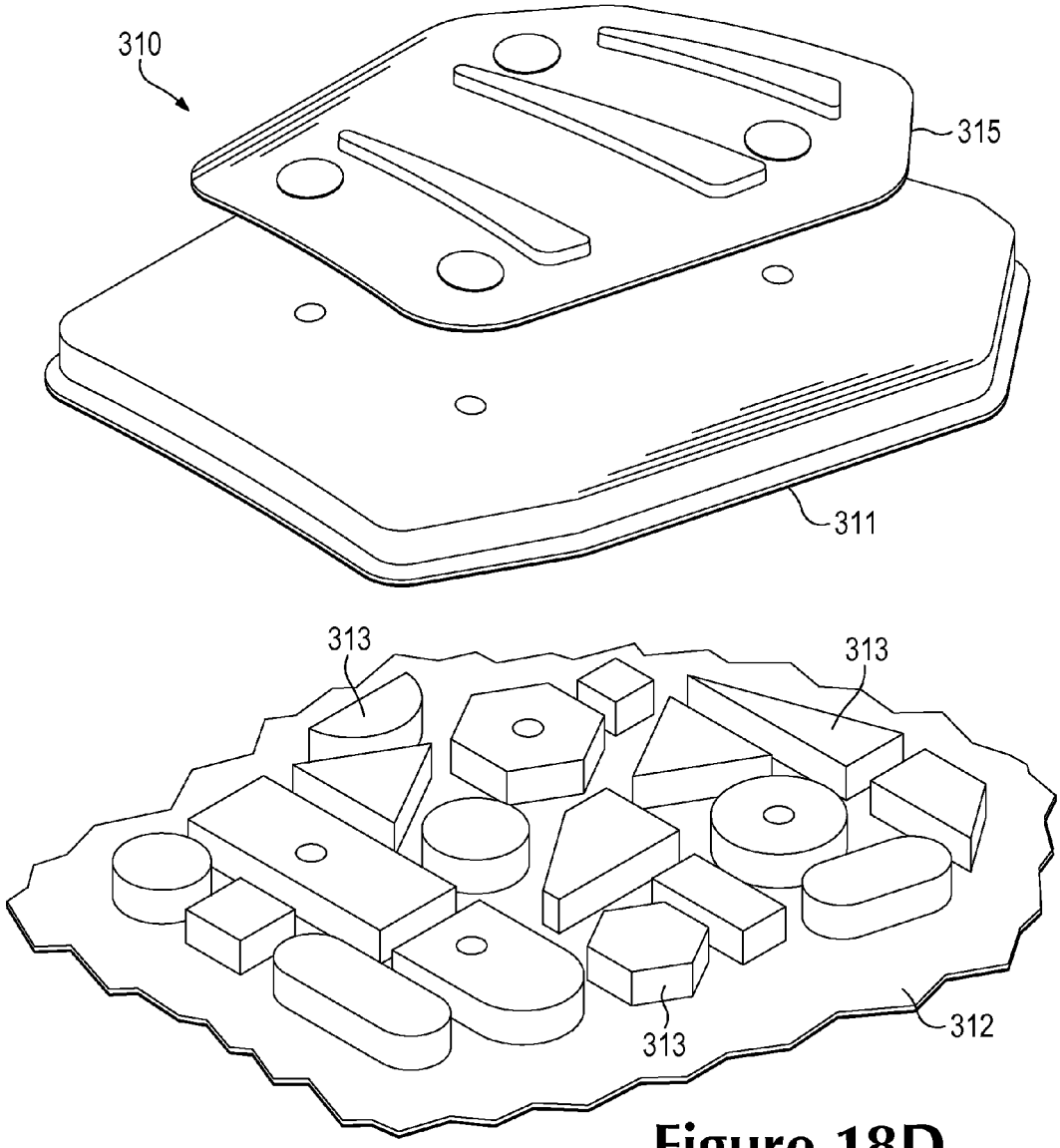

A further configuration of protective element 310 is depicted in FIG. 18A, wherein securing elements 326 are absent. In this configuration, each of pad components 313 have similar shapes and do not define apertures (i.e., apertures 324) for receiving securing elements 326. In order to secure plate 315, adhesive or thermal bonding, stitching, or a hook-and-loop fastener may be utilized. Referring to FIG. 18B, ribs 328 are absent from plate 315 and a plurality of apertures 327 extend through plate 315. Advantages of the various apertures 327 are that the flexibility and breathability of plate 315 may be increased. Pad components 313 are discussed above as having an elliptical or generally elongate shape with rounded end areas. Pad components 313 may, however, have a variety of other shapes, including hexagonal shapes, as depicted in FIG. 18C. Pad components 313 may also have a variety of other shapes, such as round shapes, triangular shapes, rectangular shapes, or irregular shapes. Pad components 313 may also have a mixture of different shapes, as depicted in FIG. 18D. Additionally, frame 314 may be absent from some configurations, as also depicted in FIGS. 18C and 18D.

Figure 19A:
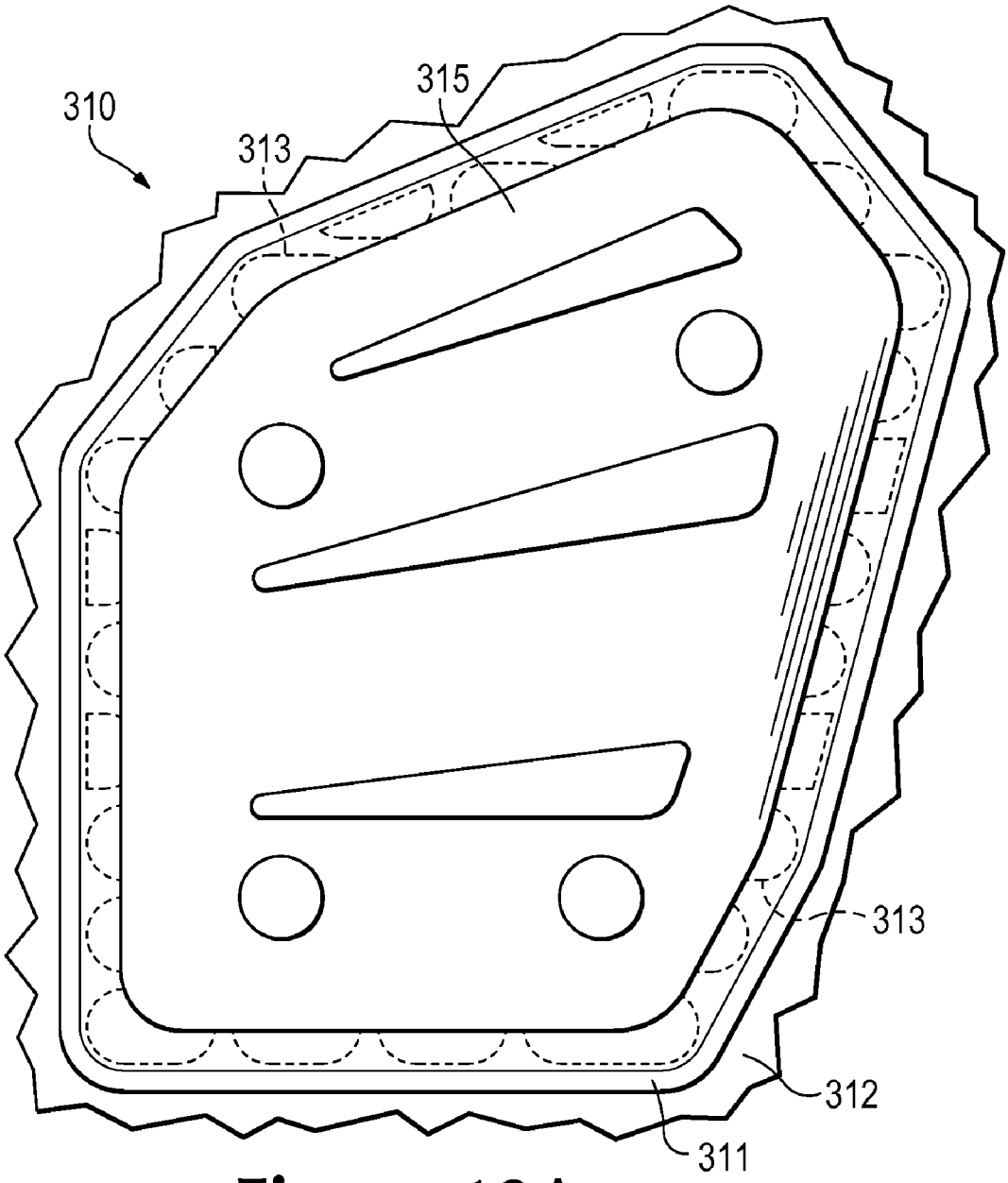
FIGS. 19A-19E are top plan views corresponding with FIG. 15 and depicting further configurations of the protective element.
Figure 19B:
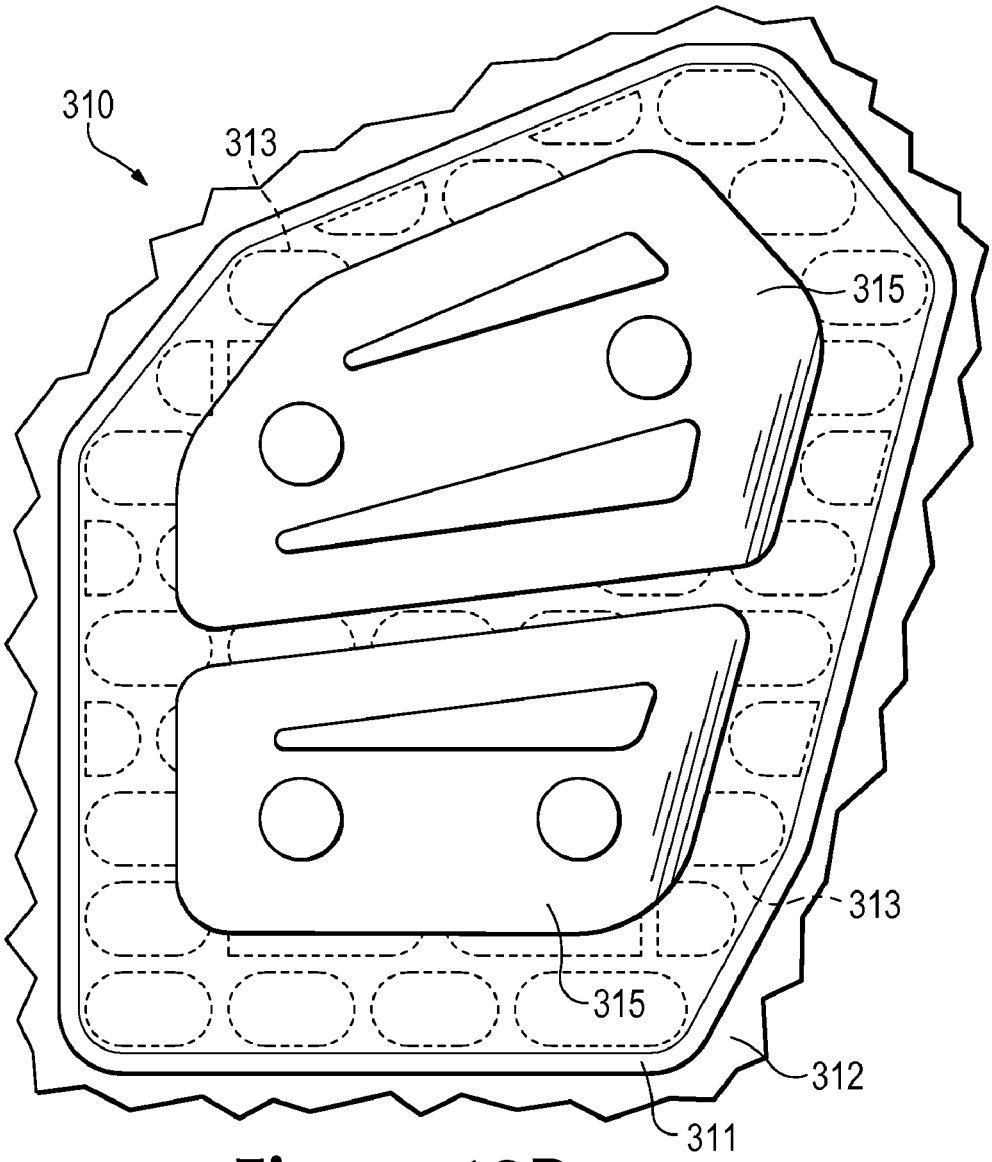
Figure 19C:
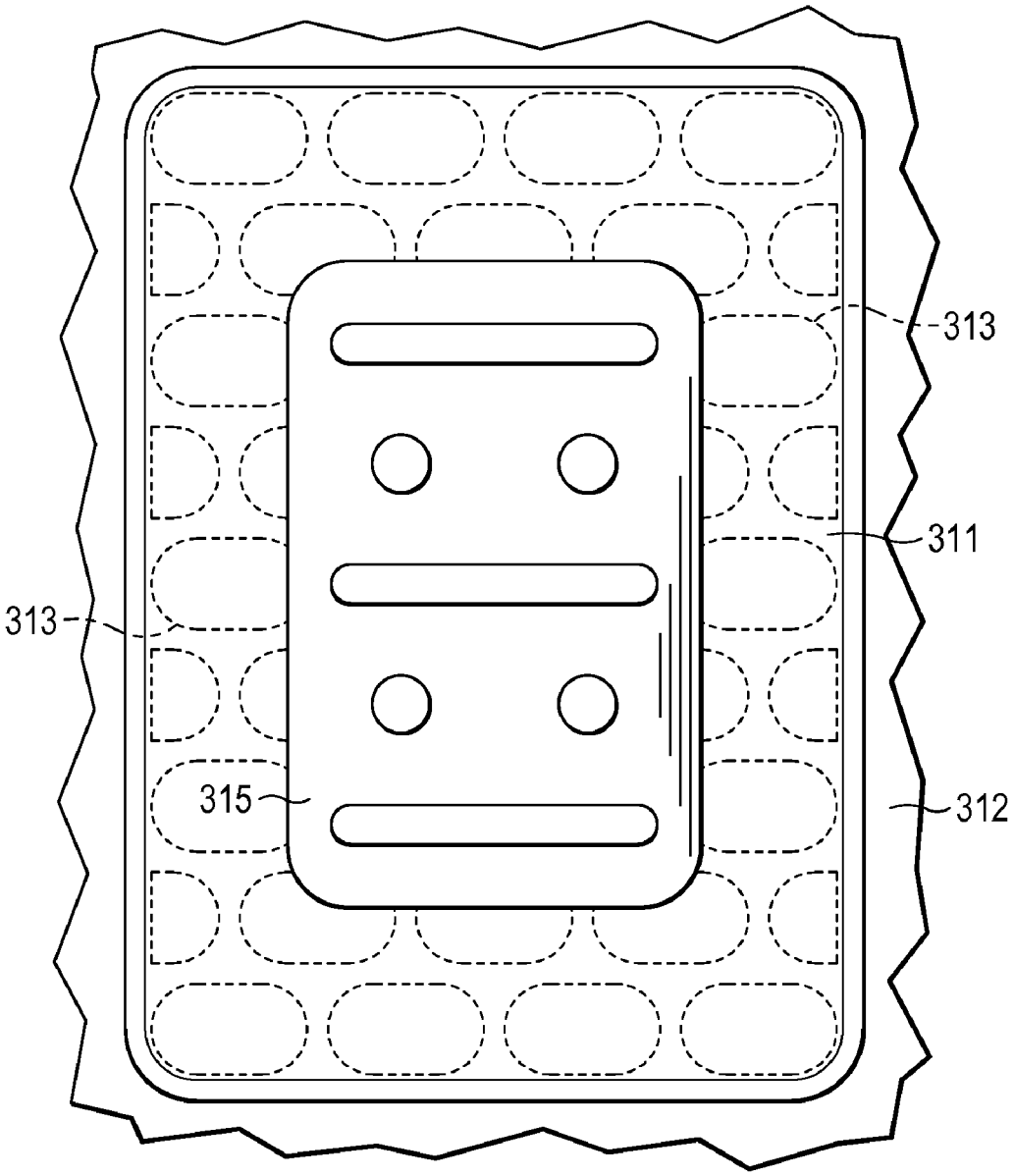
Figure 19D:
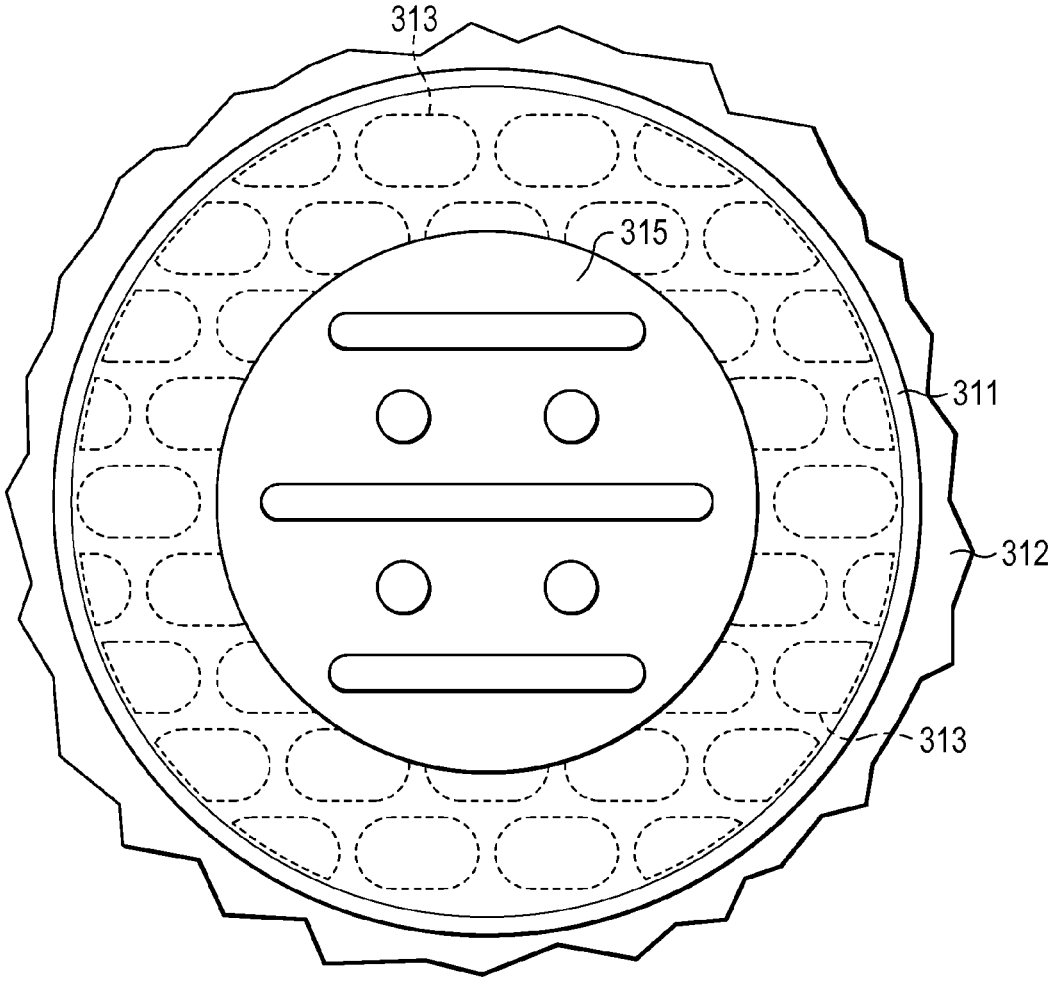
Figure 19E:
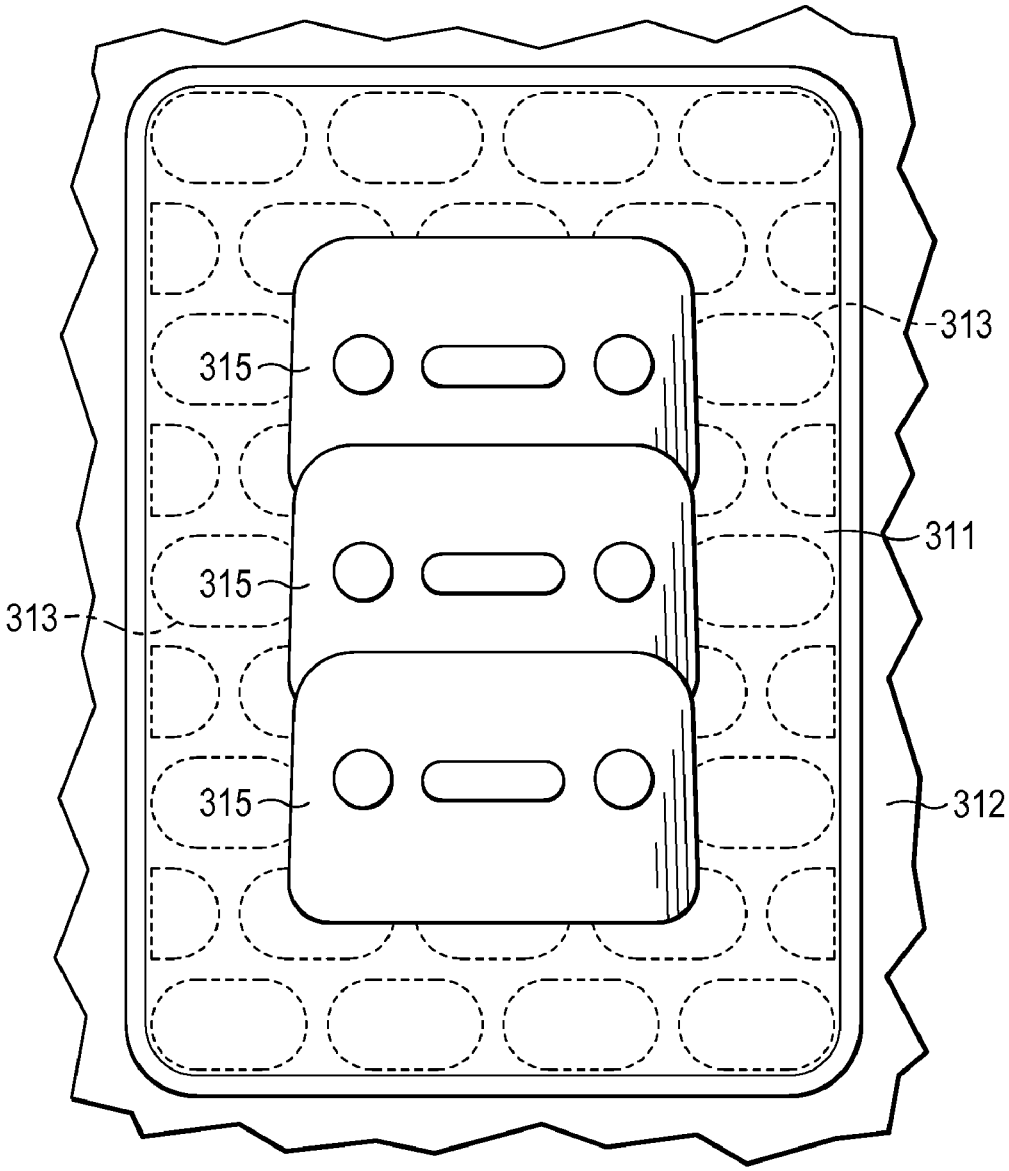

Plate 315 may cover a majority or even all of protective element 310, as depicted in FIG. 19A. In further configurations, two or more plates 315 may be utilized, as depicted in FIG. 19B. In addition to changes in the shape of plate 315, the overall shape of protective element 310 may vary significantly, as depicted by the rectangular and circular shapes in FIGS. 19C and 19D. As noted above with the configuration of FIG. 19A, two or more plates 315 may be utilized. Referring to FIG. 19E, a similar configuration wherein three separate plates 315 overlap each other is depicted to impart flexibility without gaps or other discontinuities between plates 315.

Figure 20A:
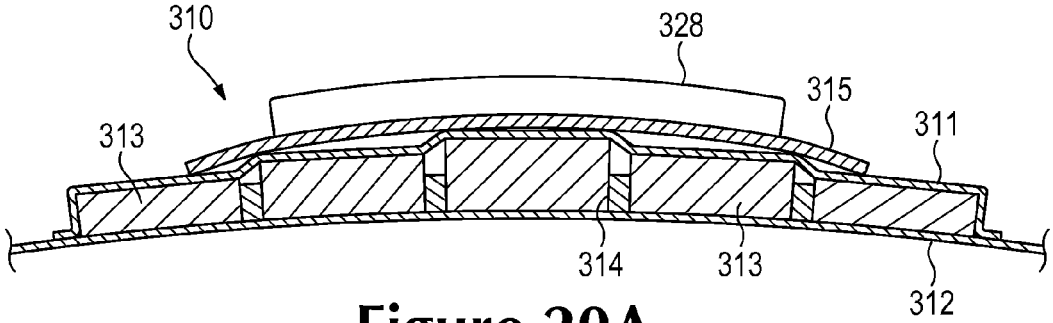
FIGS. 20A-20C are cross-sectional views corresponding with FIG. 16A and depicting further configurations of the protective element.
Figure 20B:
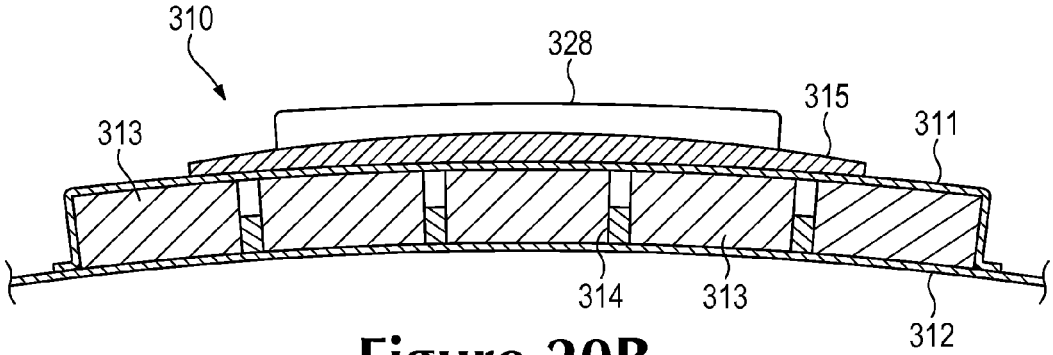
Figure 20C:
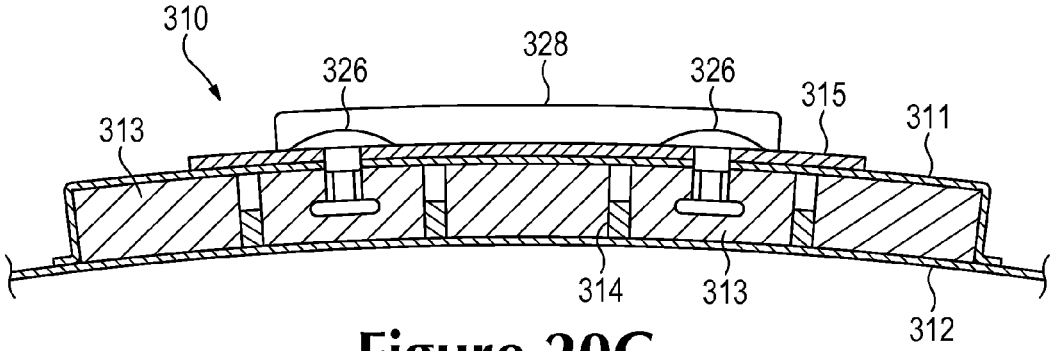

Although the thicknesses of pad components 313 may be substantially identical, the thicknesses may also vary, as depicted in FIG. 20A. The thickness of plate 315 may also vary. As depicted in FIG. 20B, the thickness of plate 315 tapers across the width of protective element 310. In some configurations of protective element 310, securing elements 326 may also be anchored within pad components 313, rather than extending through pad components 313.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a first material layer and a second material layer;

a plurality of pad components located between the first material layer and the second material layer;

a plate positioned adjacent to the first material layer, the plate and the pad components being located on opposite sides of the first material layer; and a frame located between the first material layer and the second material layer, the frame defining a plurality of apertures that receive at least a portion of the pad components, and the frame being unsecured to the first material layer, the second material layer, and the pad components.

2. The article of apparel recited in claim 1, wherein at least one of the pad components defines an aperture, the plate being secured through the aperture.

3. The article of apparel recited in claim 1, wherein an aperture extends through the first material layer, the second material layer, and at least one of the pad components, the plate being secured through the aperture.

4. The article of apparel recited in claim 1, further including at least one securing element extending from the plate to at least one of the pad components.

5. The article of apparel recited in claim 1, wherein a first portion of the pad components are located adjacent to the plate, and a second portion of the pad components are located around a periphery of the plate.

6. The article of apparel recited in claim 1, wherein the pad components are discrete polymer foam elements.

7. The article of apparel recited in claim 1, wherein opposite surfaces of the pad components are secured to the first material layer and the second material layer.

8. The article of apparel recited in claim 1, wherein the first material layer and the second material layer are textile materials, the pad components are formed from a polymer foam material, and the plate is formed from a polymer material, the polymer material of the plate having greater rigidity and density than the polymer foam material.

9. The article of apparel recited in claim 1, wherein the first material layer is joined to the second material layer around a periphery of the pad components.

10. An article of apparel comprising:

a first material layer and a second material layer, the first material layer being positioned exterior of the second material layer;

a plurality of discrete pad components formed from a polymer foam material, the pad components being located between the first material layer and the second material layer, and the pad components being secured to both the first material layer and the second material layer; and a plate located adjacent to the first material layer and exterior of the first material layer, the plate being formed from a polymer material with greater rigidity than the polymer foam material, wherein a first portion of the pad components are located adjacent to the plate, and a second portion of the pad components are located around a periphery of the plate.

11. The article of apparel recited in claim 10, wherein at least one of the pad components defines an aperture, the plate being secured through the aperture.

12. The article of apparel recited in claim 10, further including at least one securing element extending from the plate to at least one of the pad components.

13. The article of apparel recited in claim 10, wherein the first material layer and the second material layer are textile materials.

14. The article of apparel recited in claim 10, wherein a frame is located between the first material layer and the second material layer, the frame defining a plurality of apertures that receive at least a portion of the pad components, and the frame being unsecured to the first material layer, the second material layer, and the pad components.

15. An apparel system comprising:

an inner garment that includes:

a first material layer and a second material layer, the first material layer being positioned exterior of the second material layer, a plurality of pad components located between the first material layer and the second material layer, the pad components being secured to both the first material layer and the second material layer, and a plate located adjacent to the first material layer and exterior of the first material layer; and an outer garment positionable to extend over the inner garment, the outer garment including an outer pad locatable to extend over the plate, the outer pad having a greater area than the plate.

16. The apparel system recited in claim 15, wherein the inner garment and the outer garment are pants-type garments.

17. The apparel system recited in claim 15, wherein the outer garment includes two material layers located on opposite sides of the outer pad.

18. The apparel system recited in claim 15, wherein a first portion of the pad components are located adjacent to the plate, and a second portion of the pad components are located around a periphery of the plate.

19. The apparel system recited in claim 15, wherein the pad components are discrete polymer foam elements.

20. The apparel system recited in claim 15, wherein opposite surfaces of the pad components are secured to the first material layer and the second material layer.

21. The apparel system recited in claim 15, wherein the first material layer and the second material layer are textile materials, the pad components and the outer pad are formed from a polymer foam material, and the plate is formed from a polymer material, the polymer material of the plate having greater rigidity and density than the polymer foam material.

22. The apparel system recited in claim 15, wherein the first material layer is joined to the second material layer around a periphery of the pad components.

23. The apparel system recited in claim 15, wherein a frame is located between the first material layer and the second material layer, the frame defining a plurality of apertures that receive at least a portion of the pad components, and the frame being unsecured to the first material layer, the second material layer, and the pad components.

24. An apparel system including at least one garment, the apparel system having an inner surface positioned to face toward a wearer, and the apparel system having an outer surface positioned to face away from the wearer, at least a portion of the apparel system having a layered structure between the inner surface and the outer surface, the layers comprising:

a first textile element forming at least a portion of the inner surface;

a plurality of separate first pad elements positioned exterior of the first textile element, the first pad elements being secured to the first textile element, and the first pad elements being at least partially formed from a polymer foam material;

a second textile element positioned exterior of the first pad elements, the second textile element being secured to the first pad elements;

a plate element positioned exterior of the second textile element, the plate element being formed from a polymer material with greater rigidity than the polymer foam material; and at least one second pad element positioned exterior of the plate element, the second pad element having a greater area than the plate element.

25. The apparel system recited in claim 24, wherein the at least one garment includes a first garment and a second garment.

26. The apparel system recited in claim 25, wherein the first garment includes the first textile element, the first pad elements, the second textile element, and the plate element, and the second garment includes the second pad element.

27. The apparel system recited in claim 26, wherein the second garment further includes a pair of material elements located on opposite sides of the second pad element, one of the material elements being locatable between the second pad element and the plate element.

28. The apparel system recited in claim 24, wherein a first portion of the first pad elements are located adjacent to the plate element, and a second portion of the first pad elements are located around a periphery of the plate element.

29. The apparel system recited in claim 24, wherein the first textile element is joined to the second textile element around a periphery of the first pad elements.

30. The apparel system recited in claim 24, wherein a frame element is located between the first textile element and the second textile element, the frame element defining a plurality of apertures that receive at least a portion of the first pad elements, and the frame element being unsecured to the first textile element, the second textile element, and the first pad elements.

* * * * *